US008259098B2

(12) United States Patent
Seto

(10) Patent No.: US 8,259,098 B2
(45) Date of Patent: Sep. 4, 2012

(54) DISPLAY APPARATUS AND DRIVE CONTROL METHOD FOR THE SAME

(75) Inventor: Yasuhiro Seto, Kanagawa-ken (JP)

(73) Assignee: Fujifilm Corporation (JP)

( * ) Notice: Subject to any disclaimer, the term of this patent is extended or adjusted under 35 U.S.C. 154(b) by 563 days.

(21) Appl. No.: 12/543,300

(22) Filed: Aug. 18, 2009

(65) Prior Publication Data

US 2010/0039422 A1 Feb. 18, 2010

(30) Foreign Application Priority Data

Aug. 18, 2008 (JP) ..... 2008-209535

(51) Int. Cl.
*G09G 5/00* (2006.01)

(52) U.S. Cl. ..... 345/212; 345/76; 345/210

(58) Field of Classification Search ..... 345/76–83, 345/87–95, 204–215; 315/169.1–169.3
See application file for complete search history.

(56) References Cited

U.S. PATENT DOCUMENTS

| | | | | |
|---|---|---|---|---|
| 5,684,365 | A | 11/1997 | Tang et al. | |
| 6,693,388 | B2 * | 2/2004 | Oomura | 315/169.3 |
| 6,870,522 | B2 * | 3/2005 | Sagano et al. | 345/75.2 |
| 7,046,240 | B2 * | 5/2006 | Kimura | 345/212 |
| 7,088,052 | B2 * | 8/2006 | Kimura | 315/169.2 |
| 7,358,941 | B2 | 4/2008 | Ono et al. | |
| 7,408,533 | B2 * | 8/2008 | Eom et al. | 345/76 |
| 2007/0210996 | A1 | 9/2007 | Mizukoshi et al. | |
| 2007/0268210 | A1 | 11/2007 | Uchino et al. | |

FOREIGN PATENT DOCUMENTS

| | | | |
|---|---|---|---|
| JP | 2002-278513 | A | 9/2002 |
| JP | 2003-255856 | A | 9/2003 |
| JP | 2006-301250 | A | 11/2006 |

OTHER PUBLICATIONS

Japanese Office Action "Notice of Grounds for Rejection" dated May 29, 2012; Japanese Patent Application No. 2008-209535 with partial translation.

* cited by examiner

*Primary Examiner* — Vijay Shankar
(74) *Attorney, Agent, or Firm* — Studebaker & Brackett PC; Donald R. Studebaker

(57) ABSTRACT

Supplying first and second measuring voltages to a source terminal of a drive transistor to obtain first and second voltage variations at the source terminal of the drive transistor when a parasitic capacitance of a light emitting element is charged by currents flowed through the drive transistor by the supply of the voltages, obtaining first and second current values of the drive current of the drive transistor based on the first and second voltage variations, obtaining characteristic values of the drive transistor based on the first and second measuring voltages and the first and second current values, and outputting a data signal based on the obtained characteristic values and a drive voltage of the drive transistor corresponding to the amount of emission of the light emitting element to the source terminal of the drive transistor.

18 Claims, 15 Drawing Sheets

DISPLAY APPARATUS AND DRIVE CONTROL METHOD FOR THE SAME

BACKGROUND OF THE INVENTION

1. Field of the Invention

The present invention relates to a display apparatus having a light emitting element driven by an active matrix method and a drive control method for the display apparatus.

2. Description of the Related Art

Display devices using light emitting elements, such as organic EL elements, for use in various applications, including televisions, cell phone displays, and the like, have been proposed.

Generally, organic EL elements are current driven light emitting elements and, unlike a liquid crystal display, require, as minimum, selection transistors for selecting pixel circuits, holding capacitors for holding charges according to an image to be displayed, and drive transistors for driving the organic EL elements as the drive circuit as described, for example, U.S. Pat. No. 5,684,365 (Patent Document 1).

Heretofore, thin film transistors of low-temperature polysilicon or amorphous silicon have been used in pixel circuits of active matrix organic EL display devices.

The low-temperature polysilicon thin film transistor may provide high mobility and stability of threshold voltage, but has a problem that the mobility is not uniform. The amorphous silicon thin film transistor may provide uniform mobility, but has a problem that the mobility is low and threshold voltage varies with time.

The non-uniform mobility and instable threshold voltage appear as irregularities in the displayed image. Consequently, for example, Japanese Unexamined Patent Publication No. 2003-255856 (Patent Document 2) proposes a display device in which a compensation circuit of diode connection method is provided in the pixel circuit.

The provision of the compensation circuit described in Patent Document 2, however, causes the pixel circuit to become complicated, resulting in increased cost due to low yield rate and low aperture ratio.

As such, for example, Japanese Unexamined Patent Publication Nos. 2002-278513 (Patent Document 3) and U.S. Patent Application Publication No. 20070210996 (Patent Document 4) propose a method in which a current meter is provided outside of the active matrix substrate, on which pixel circuits are disposed, with respect to each pixel circuit row to measure a current of each drive transistor by the current meter, then characteristic values of each drive transistor, including the threshold voltage, mobility, and the like, are calculated based on the measured drive current value and stored, and correction data are programmed into each pixel circuit as the gate voltage of each drive transistor based on the characteristic values, thereby achieving both the simplicity of pixel circuits and characteristic correction of drive transistors.

The method described in Patent Document 3 and Patent Document 4, however, can not measure the drive current accurately because the extinction current of an organic EL element of a non-selected pixel circuit gets into the measured drive current. Further, the method measures a very small drive current for one pixel circuit and has a problem in the measurement accuracy of the current from a practical viewpoint. Still further, the method can not perform the acquisition of correction data and display operation at the same time since it requires time for the measurement of drive currents, so that real time update of the correction data is impossible.

In the mean time, as for methods for correcting a characteristic variation of a drive transistor within the pixel circuit, a correction method with a simpler pixel circuit configuration is proposed as described, for example, in U.S. Patent Application Publication No. 20070268210 (Patent Document 5).

The correction method described in Patent Document 5 is a method in which the threshold voltage of a drive transistor is detected by charging a parasitic capacitance of the organic EL element, then a voltage variation is converted to the deviation of mobility μ, and the gate-source voltage to be supplied to the drive transistor is automatically corrected.

The method described in Patent Document 5, however, needs to perform control of rising and falling slopes of data signals in order to cover deviations in the parasitic capacitances of organic EL elements and fact that μ correction current differs each time according to the image data, and to perform correction for the influence of the resistance and capacitance of data lines. That is, the simplicity of pixel circuits is achieved at the expense of complicated drive control, requiring the drive control circuit to have an extraordinary accuracy so that the overall cost of the display apparatus is increased.

Further, U.S. Pat. No. 7,358,941 (Patent Document 6) proposes a method in which a wiring capacitance is used instead of charging the parasitic capacitance of an organic EL element as in Patent Document 5, and the voltage of the wiring capacitance is read by the drive circuit, whereby the properties of the drive transistor are corrected.

In the method described in Patent Document 6, although the measurement of a very small drive current, which is the problem of the method described in Patent Document 3 and Patent Document 4, can be realized by a simple voltage measurement, but it takes a long time to acquire correction data because it uses the wiring capacitance of the common potential line as the load capacitance.

In view of the circumstances described above, it is an object of the present invention to provide a display apparatus and a drive control method of the display apparatus capable of realizing accurate correction of characteristic deviations of drive transistors, simultaneous display operation and acquisition of characteristic values, and simplified pixel circuits and drive control of the circuits.

SUMMARY OF THE INVENTION

A first display apparatus drive control method of the present invention is a method for drive controlling a display apparatus which includes an active matrix substrate with an array of multiple pixel circuits, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and a data line that supplies a predetermined data signal, the method including the steps of:

- supplying a preset first measuring voltage to the source terminal of the drive transistor via the data line and source connection switch;
- acquiring a first voltage variation at the source terminal of the drive transistor when a capacitive load connected to the source terminal of the drive transistor is charged by a current flowing through the drive transistor by the supply of the first measuring voltage and acquiring a first current value with respect to the drive current of the drive transistor based on the first voltage variation;

supplying a preset second measuring voltage to the source terminal of the drive transistor via the data line and source connection switch;

acquiring a second voltage variation at the source terminal of the drive transistor when the capacitive load connected to the source terminal of the drive transistor is charged by a current that flows through the drive transistor by the supply of the second measuring voltage and acquiring a second current value with respect to the drive current of the drive transistor based on the second voltage variation;

acquiring threshold voltage based and mobility based characteristic values of the drive transistor based on the first measuring voltage, second measuring voltage, first current value, and second current value; and outputting a data signal based on the obtained characteristic values and a drive voltage of the drive transistor corresponding to the amount of emission of the light emitting element to the source terminal of the drive transistor via the data line and source connection switch.

A second display apparatus drive control method of the present invention is a method for drive controlling a display apparatus which includes an active matrix substrate with an array of multiple pixel circuits, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and a data line that supplies a predetermined data signal, the method including the steps of:

supplying a preset measuring voltage to the source terminal of the drive transistor via the data line and source connection switch;

acquiring a voltage variation at the source terminal of the drive transistor when a capacitive load connected to the source terminal of the drive transistor is charged by a current flowing through the drive transistor by the supply of the measuring voltage and acquiring a current value with respect to the drive current of the drive transistor based on the voltage variation;

acquiring a threshold voltage based or a mobility based characteristic value of the drive transistor based on the measuring voltage and current value; and outputting a data signal based on the obtained characteristic value and a drive voltage of the drive transistor corresponding to the amount of emission of the light emitting element to the source terminal of the drive transistor via the data line and source connection switch.

A third display apparatus drive control method of the present invention is a method for drive controlling a display apparatus which includes: an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line; a scan drive unit for sequentially selecting pixel circuit rows and turning ON the source connection switches of pixel circuits in the selected pixel circuit row; and a control unit for displaying an image based on a data signal with respect to each frame by causing the scan drive unit to repeat the selection from the first to last pixel circuit row, the method including the steps of:

sequentially switching and selecting some of pixel circuits in a pixel circuit row selected by the scan drive unit with respect to each frame;

for each selection pixel circuit selected from those in the pixel circuit row selected by the scan drive unit:

supplying a preset first measuring voltage to the source terminal of the drive transistor via the data line and source connection switch and acquiring a first voltage variation at the source terminal of the drive transistor when a capacitive load connected to the source terminal of the drive transistor is charged by a current flowing through the drive transistor by the supply of the first measuring voltage and acquiring a first current value with respect to the drive current of the drive transistor based on the first voltage variation;

supplying a preset second measuring voltage to the source terminal of the drive transistor via the data line and source connection switch and acquiring a second voltage variation at the source terminal of the drive transistor when the capacitive load connected to the source terminal of the drive transistor is charged by a current that flows through the drive transistor by the supply of the second measuring voltage and acquiring a second current value with respect to the drive current of the drive transistor based on the second voltage variation; and acquiring threshold voltage based and mobility based characteristic values of the drive transistor based on the first measuring voltage, second measuring voltage, first current value, and second current value, outputting a data signal based on the obtained characteristic values and a drive voltage of the drive transistor corresponding to the amount of emission of the light emitting element to the source terminal of the drive transistor via the data line and source connection switch, and storing the obtained characteristic values in a characteristic value storage unit, and for each non-selection pixel circuit not selected from those in the pixel circuit row selected by the scan drive unit, outputting a data signal based on the characteristic values stored in the characteristic value storage unit when selected last time and a drive voltage of the drive transistor corresponding to the amount of emission of the light emitting element to the source terminal of the drive transistor via the data line and source connection switch.

A fourth display apparatus drive control method of the present invention is a method for drive controlling a display apparatus which includes: an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line; a scan drive unit for sequentially selecting pixel circuit rows and turning ON the source connection switches of pixel circuits in the selected pixel circuit row; and a control unit for displaying an image based on a data signal with respect to each frame by causing the scan drive unit to repeat the selection from the first to last pixel circuit row, the method including the steps of:

sequentially switching and selecting some of pixel circuits in a pixel circuit row selected by the scan drive unit with respect to each frame;

for each selection pixel circuit selected from those in the pixel circuit row selected by the scan drive unit:

supplying a preset measuring voltage to the source terminal of the drive transistor via the data line and source connection switch and acquiring a voltage variation at the source terminal of the drive transistor when a capacitive load connected to the source terminal of the drive transistor is charged by a current flowing through the drive transistor by the supply of the measuring voltage and acquiring a current value with respect to the drive current of the drive transistor based on the voltage variation; and acquiring a threshold voltage based or a mobility based characteristic value of the drive transistor based on the measuring voltage and current value, outputting a data signal based on the obtained characteristic value and a drive voltage of the drive transistor corresponding to the amount of emission of the light emitting element to the source terminal of the drive transistor via the data line and source connection switch, and storing the obtained characteristic value in a characteristic value storage unit, and for each non-selection pixel circuit not selected from those in the pixel circuit row selected by the scan drive unit, outputting a data signal based on the characteristic value stored in the characteristic value storage unit when selected last time and a drive voltage of the drive transistor corresponding to the amount of emission of the light emitting element to the source terminal of the drive transistor via the data line and source connection switch.

A fifth display apparatus drive control method of the present invention is a method for drive controlling a display apparatus which includes: an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line; a scan drive unit for sequentially selecting pixel circuit rows and turning ON the source connection switches of pixel circuits in the selected pixel circuit row; and a control unit for displaying an image based on a data signal with respect to each frame by causing the scan drive unit to repeat the selection from the first to last pixel circuit row, the method including the steps of:

sequentially switching and selecting some of the first to last pixel circuit row with respect to each frame;

for each pixel circuit in each selection pixel circuit row selected:

supplying a preset first measuring voltage to the source terminal of the drive transistor via the data line and source connection switch and acquiring a first voltage variation at the source terminal of the drive transistor when a capacitive load connected to the source terminal of the drive transistor is charged by a current flowing through the drive transistor by the supply of the first measuring voltage and acquiring a first current value with respect to the drive current of the drive transistor based on the first voltage variation;

supplying a preset second measuring voltage to the source terminal of the drive transistor via the data line and source connection switch and acquiring a second voltage variation at the source terminal of the drive transistor when the capacitive load connected to the source terminal of the drive transistor is charged by a current that flows through the drive transistor by the supply of the second measuring voltage and acquiring a second current value with respect to the drive current of the drive transistor based on the second voltage variation; and acquiring threshold voltage based and mobility based characteristic values of the drive transistor based on the first measuring voltage, second measuring voltage, first current value, and second current value, outputting a data signal based on the obtained characteristic values and a drive voltage of the drive transistor corresponding to the amount of emission of the light emitting element to the source terminal of the drive transistor via the data line and source connection switch, and storing the obtained characteristic values in a characteristic value storage unit, and for each pixel circuit in each non-selection pixel circuit row not selected, outputting a data signal based on the characteristic values stored in the characteristic value storage unit when selected last time and a drive voltage of the drive transistor corresponding to the amount of emission of the light emitting element to the source terminal of the drive transistor via the data line and source connection switch.

A sixth display apparatus drive control method of the present invention is a method for drive controlling a display apparatus which includes: an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line; a scan drive unit for sequentially selecting pixel circuit rows and turning ON the source connection switches of pixel circuits in the selected pixel circuit row; and a control unit for displaying an image based on a data signal with respect to each frame by causing the scan drive unit to repeat the selection from the first to last pixel circuit row, the method including the steps of:

sequentially switching and selecting some of the first to last pixel circuit row with respect to each frame;

for each pixel circuit in each selection pixel circuit row selected:

supplying a preset measuring voltage to the source terminal of the drive transistor via the data line and source connection switch and acquiring a voltage variation at the source terminal of the drive transistor when a capacitive load connected to the source terminal of the drive transistor is charged by a current flowing through the drive transistor by the supply of the measuring voltage and acquiring a current value with respect to the drive current of the drive transistor based on the voltage variation; and acquiring a threshold voltage based or a mobility based characteristic value of the drive transistor based on the measuring voltage and current value, outputting a data signal based on the obtained characteristic value and a drive voltage of the drive transistor corresponding to the amount of emission of the light emitting element to the source terminal of the drive transistor via the data line and source connection switch, and storing the obtained characteristic value in a characteristic value storage unit, and for each pixel circuit in each non-selection pixel circuit row not selected, outputting a data signal based on the characteristic value stored in the characteristic value storage unit when selected last time and a drive voltage of the drive transistor corresponding to the amount of emission of the light emitting element to the source terminal of the drive transistor via the data line and source connection switch.

A first display apparatus of the present invention is an apparatus, including:

an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line, and a source drive circuit having a current value acquisition unit for supplying a preset first measuring voltage to the source terminal of the drive transistor via the data line and source connection switch, acquiring a first voltage variation at the source terminal of the drive transistor when a capacitive load connected to the source terminal of the drive transistor is charged by a current flowing through the drive transistor by the supply of the first measuring voltage, acquiring a first current value with respect to the drive current of the drive transistor based on the first voltage variation, supplying a preset second measuring voltage to the source terminal of the drive transistor via the data line and source connection switch, acquiring a second voltage variation at the source terminal of the drive transistor when the capacitive load connected to the source terminal of the drive transistor is charged by a current that flows through the drive transistor by the supply of the second measuring voltage, and acquiring a second current value with respect to the drive current of the drive transistor based on the second voltage variation, a characteristic value acquisition unit for acquiring threshold voltage based and mobility based characteristic values of the drive transistor based on the first measuring voltage, second measuring voltage, first current value, and second current value, and a data signal output unit for outputting a data signal based on the characteristic values obtained by the characteristic value acquisition unit and a drive voltage of the drive transistor corresponding to the amount of emission of the light emitting element to the source terminal of the drive transistor via the data line and source connection switch.

A second display apparatus of the present invention is an apparatus, including:

an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line; and a source drive circuit having a current value acquisition unit for supplying a preset measuring voltage to the source terminal of the drive transistor via the data line and source connection switch, acquiring a voltage variation at the source terminal of the drive transistor when a capacitive load connected to the source terminal of the drive transistor is charged by a current flowing through the drive transistor by the supply of the measuring voltage, and acquiring a current value with respect to the drive current of the drive transistor based on the voltage variation, a characteristic value acquisition unit for acquiring a threshold voltage based or a mobility based characteristic value of the drive transistor based on the measuring voltage and current value, and a data signal output unit for outputting a data signal based on the characteristic value obtained by the characteristic value acquisition unit and a drive voltage of the drive transistor corresponding to the amount of emission of the light emitting element to the source terminal of the drive transistor via the data line and source connection switch.

A third display apparatus of the present invention is an apparatus, including:

an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line;

a scan drive unit for sequentially selecting pixel circuit rows and turning ON the source connection switches of pixel circuits in the selected pixel circuit row;

a source drive unit having a current value acquisition unit for supplying a preset first measuring voltage to the source terminal of the drive transistor via the data line and source connection switch, acquiring a first voltage variation at the source terminal of the drive transistor when a capacitive load connected to the source terminal of the drive transistor is charged by a current flowing through the drive transistor by the supply of the first measuring voltage, acquiring a first current value with respect to the drive current of the drive transistor based on the first voltage variation, supplying a preset second measuring voltage to the source terminal of the drive transistor via the data line and source connection switch, acquiring a second voltage variation at the source terminal of the drive transistor when the capacitive load connected to the source terminal of the drive transistor is charged by a current that flows through the drive transistor by the supply of the second measuring voltage, and acquiring a second current value with respect to the drive current of the drive transistor based on the second voltage variation, a characteristic value acquisition unit for acquiring threshold voltage based and mobility based characteristic values of the drive transistor based on the first measuring voltage, second measuring voltage, first current value, and second current value, and a data signal output unit for outputting a data signal based on the characteristic values obtained by the characteristic value acquisition unit and a drive voltage of the drive transistor corresponding to the amount of emission of the light emitting element to the source terminal of the drive transistor via the data line and source connection switch;

a characteristic value storage unit for storing characteristic values of the drive transistor of each pixel circuit; and a control unit for displaying an image based on a data signal with respect to each frame by causing the scan drive unit to repeat the selection from the first to last pixel circuit row, wherein:

the current value acquisition unit is a unit that sequentially switches and selects some of pixel circuits in a pixel circuit row selected by the scan drive unit with respect to each frame and obtains the first and second current values of each selected pixel circuit;

the characteristic value acquisition unit is a unit that obtains the characteristic values of each pixel circuit selected by the current value acquisition unit and outputs the obtained characteristic values to the characteristic value storage unit to update previously stored characteristic values of each selected pixel circuit; and the data signal output unit is a unit that outputs, for each selection pixel circuit selected by the current value acquisition unit, a data signal based on the characteristic values obtained by the characteristic value acquisition unit when selected and a drive voltage of the drive transistor corresponding to the amount of emission of the light emitting element to the source terminal of the drive transistor of each selection pixel circuit via the data line and source connection switch and outputs, for each non-selection pixel circuit not selected by the current value acquisition unit, a data signal based on the characteristic values stored in the characteristic value storage unit when selected last time and a drive voltage of the drive transistor corresponding to the amount of emission of the light emitting element to the source terminal of the drive transistor of each non-selection pixel circuit via the data line and source connection switch.

A fourth display apparatus of the present invention is an apparatus, including:

an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line;

a scan drive unit for sequentially selecting pixel circuit rows and turning ON the source connection switches of pixel circuits in the selected pixel circuit row;

a source drive unit having a current value acquisition unit for supplying a preset measuring voltage to the source terminal of the drive transistor via the data line and source connection switch, acquiring a voltage variation at the source terminal of the drive transistor when a capacitive load connected to the source terminal of the drive transistor is charged by a current flowing through the drive transistor by the supply of the measuring voltage, and acquiring a current value with respect to the drive current of the drive transistor based on the voltage variation, a characteristic value acquisition unit for acquiring a threshold voltage based or a mobility based characteristic value of the drive transistor based on the measuring voltage and current value, and a data signal output unit for outputting a data signal based on the characteristic value obtained by the characteristic value acquisition unit and a drive voltage of the drive transistor corresponding to the amount of emission of the light emitting element to the source terminal of the drive transistor via the data line and source connection switch;

a characteristic value storage unit for storing a characteristic value of the drive transistor of each pixel circuit; and a control unit for displaying an image based on a data signal with respect to each frame by causing the scan drive unit to repeat the selection from the first to last pixel circuit row, wherein:

the current value acquisition unit is a unit that sequentially switches and selects some of pixel circuits in a pixel circuit row selected by the scan drive unit with respect to each frame and obtains the current value of each selected pixel circuit;

the characteristic value acquisition unit is a unit that obtains the characteristic value of each pixel circuit selected by the current value acquisition unit and outputs the obtained characteristic value to the characteristic value storage unit to update previously stored characteristic value of each selected pixel circuit; and the data signal output unit is a unit that outputs, for each selection pixel circuit selected by the current value acquisition unit, a data signal based on the characteristic value obtained by the characteristic value acquisition unit when selected and a drive voltage of the drive transistor corresponding to the amount of emission of the light emitting element to the source terminal of the drive transistor of each selection pixel circuit via the data line and source connection switch and outputs, for each non-selection pixel circuit not selected by the current value acquisition unit, a data signal based on the characteristic value stored in the characteristic value storage unit when selected last time and a drive voltage of the drive transistor corresponding to the amount of emission of the light emitting element to the source terminal of the drive transistor of each non-selection pixel circuit via the data line and source connection switch.

A fifth display apparatus of the present invention is an apparatus, including:

an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line;

a scan drive unit for sequentially selecting pixel circuit rows and turning ON the source connection switches of pixel circuits in the selected pixel circuit row;

a source drive unit having a current value acquisition unit for supplying a preset first measuring voltage to the source terminal of the drive transistor via the data line and source connection switch, acquiring a first voltage variation at the source terminal of the drive transistor when a capacitive load connected to the source terminal of the drive transistor is charged by a current flowing through the drive transistor by the supply of the first measuring voltage, acquiring a first current value with respect to the drive current of the drive transistor based on the first voltage variation, supplying a preset second measuring voltage to the source terminal of the drive transistor via the data line and source connection switch, acquiring a second voltage variation at the source terminal of the drive transistor when the capacitive load connected to the source terminal of the drive transistor is charged by a current that flows through the drive transistor by the supply of the second measuring voltage, and acquiring a second current value with respect to the drive current of the drive transistor based on the second voltage variation, a characteristic value acquisition unit for acquiring threshold voltage based and mobility based characteristic values of the drive transistor based on the first measuring voltage, second measuring voltage, first current value, and second current value, and a data signal output unit for outputting a data signal based on the characteristic values obtained by the characteristic value acquisition unit and a drive voltage of the drive transistor corresponding to the amount of emission of the light emitting element to the source terminal of the drive transistor via the data line and source connection switch;

a characteristic value storage unit for storing characteristic values of the drive transistor of each pixel circuit; and a control unit for displaying an image based on a data signal with respect to each frame by causing the scan drive unit to repeat the selection from the first to last pixel circuit row, wherein:

the current value acquisition unit is a unit that sequentially switches and selects some of the first to last pixel circuit row with respect to each frame and obtains the first and second current values of each pixel circuit in each selected pixel circuit row;

the characteristic value acquisition unit is a unit that obtains the characteristic values of each pixel circuit in each pixel circuit row selected by the current value acquisition unit and outputs the obtained characteristic values to the characteristic value storage unit to update previously stored characteristic values of each pixel circuit in each selected pixel circuit row; and the data signal output unit is a unit that outputs, for each pixel circuit in each selection pixel circuit row selected by the current value acquisition unit, a data signal based on the characteristic values obtained by the characteristic value acquisition unit when selected and a drive voltage of the drive transistor corresponding to the amount of emission of the light emitting element to the source terminal of the drive transistor of each pixel circuit in each selection pixel circuit row via the data line and source connection switch and outputs, for each pixel circuit in each non-selection pixel circuit row not selected by the current value acquisition unit, a data signal based on the characteristic values stored in the characteristic value storage unit when selected last time and a drive voltage of the drive transistor corresponding to the amount of emission of the light emitting element to the source terminal of the drive transistor of each pixel circuit in each non-selection pixel circuit via the data line and source connection switch.

A sixth display apparatus of the present invention is an apparatus, including:

an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line;

a scan drive unit for sequentially selecting pixel circuit rows and turning ON the source connection switches of pixel circuits in the selected pixel circuit row;

a source drive unit having a current value acquisition unit for supplying a preset measuring voltage to the source terminal of the drive transistor via the data line and source connection switch, acquiring a voltage variation at the source terminal of the drive transistor when a capacitive load connected to the source terminal of the drive transistor is charged by a current flowing through the drive transistor by the supply of the measuring voltage, and acquiring a current value with respect to the drive current of the drive transistor based on the voltage variation, a characteristic value acquisition unit for acquiring a threshold voltage based or a mobility based characteristic value of the drive transistor based on the measuring voltage and current value, and a data signal output unit for outputting a data signal based on the characteristic value obtained by the characteristic value acquisition unit and a drive voltage of the drive transistor corresponding to the amount of emission of the light emitting element to the source terminal of the drive transistor via the data line and source connection switch;

a characteristic value storage unit for storing characteristic values of the drive transistor of each pixel circuit; and a control unit for displaying an image based on a data signal with respect to each frame by causing the scan drive unit to repeat the selection from the first to last pixel circuit row, wherein:

the current value acquisition unit is a unit that sequentially switches and selects some of the first to last pixel circuit row with respect to each frame and obtains the current value of each pixel circuit in each selected pixel circuit row;

the characteristic value acquisition unit is a unit that obtains the characteristic value of each pixel circuit in each pixel circuit row selected by the current value acquisition unit and outputs the obtained characteristic value to the characteristic value storage unit to update previously stored characteristic value of each pixel circuit in each selected pixel circuit row; and the data signal output unit is a unit that outputs, for each pixel circuit in each selection pixel circuit row selected by the current value acquisition unit, a data signal based on the characteristic value obtained by the characteristic value acquisition unit when selected and a drive voltage of the drive transistor corresponding to the amount of emission of the light emitting element to the source terminal of the drive transistor of each pixel circuit in each selection pixel circuit row via the data line and source connection switch and outputs, for each pixel circuit in each non-selection pixel circuit row not selected by the current value acquisition unit, a data signal based on the characteristic value stored in the characteristic value storage unit when selected last time and a drive voltage of the drive transistor corresponding to the amount of emission of the light emitting element to the source terminal of the drive transistor of each pixel circuit in each non-selection pixel circuit row via the data line and source connection switch.

The first to sixth display apparatuses of the present invention may further include a reverse bias voltage output unit for supplying a reverse bias voltage of a magnitude corresponding to the data signal outputted to the drive transistor to the gate terminal of the drive transistor.

Further, the drive transistor may be a thin film transistor having a current characteristic with a negative threshold voltage.

Still further, each drive transistor may be a thin film transistor of IGZO (InGaZnO).

In the third and fourth display apparatuses of the present invention, some of the pixel circuits may be pixel circuits respectively having red, green, and blue light emitting elements belonging to one display pixel.

In the first to sixth display apparatuses of the present invention, a common electrode wire may be connected to the cathode terminal of the light emitting element to supply different voltages between a reverse bias voltage application period and a period other than the reverse bias voltage application period.

Here, the term "capacitive load connected to the source terminal of the drive transistor" may include, for example, a parasitic capacitance of the light emitting element, a wiring capacitance, a gate capacitance of the source connection switch, or an auxiliary capacitor connected in parallel with the light emitting element.

According to the first to sixth display apparatuses and drive control methods therefor, a predetermined voltage and a measuring voltage is supplied to the gate terminal and source terminal of a drive transistor to obtain a value of current that flows through the drive transistor by a change in the voltage set at the source terminal. This method allows a simple and inexpensive circuit structure and an accurate measurement in a short time in comparison with a conventional method in which a very small current is measured directly.

This allows a characteristic value acquisition step for the drive transistor may be inserted in an ordinary display data updating cycle, and acquisition and correction of the characteristic values may be performed in parallel with an image display.

According to the third and fourth display apparatuses and drive control methods therefor, some of pixel circuits in a pixel circuit row selected by the scan drive unit are sequentially switched and selected with respect to each frame, and the characteristic values are obtained with respect to the selection pixel circuits selected. This eliminates the need to provide a characteristic value acquisition unit with respect to each pixel circuit column, resulting in reduced space and cost.

According to the fifth and sixth display apparatuses and drive control methods therefor, some of the first to last pixel circuit row are sequentially switched and selected with respect to each frame, and the characteristic values are obtained with respect to pixel circuits in selection pixel circuit rows selected. For example, even when a scanning time of all pixel circuit rows is short, such as in a high-resolution panel, a time for acquiring characteristic values of pixel circuits in some of the pixel circuit rows can be ensured, and characteristic values of pixel circuits in all pixel circuit rows can be obtained by changing pixel circuit rows for acquiring characteristic values with respect to each frame.

In the first to sixth display apparatuses of the present invention, when a reverse bias voltage output unit for supplying a reverse bias voltage of a magnitude corresponding to the data signal outputted to the drive transistor to the gate terminal of the drive transistor is further provided, threshold voltage shift in the drive transistor due to voltage stress may be prevented appropriately.

Further, when a reverse bias voltage is supplied to the drive transistor, as described above, the maximum voltage which can be set as the reverse bias voltage is the power source voltage, so that when a high luminance display is performed, a reverse bias shortage may possibly occur.

Where a thin film transistor having a current characteristic with a negative threshold voltage is used as the drive transistor, both positive and negative voltages are applied as Vgs at the time of image display, so that the reverse bias voltages have both positive and negative polarities, whereby the reverse bias shortage due to the limited value of reverse bias voltage may be prevented.

Further, when a common electrode wire is connected to the cathode terminal of the light emitting element to supply different voltages between a reverse bias voltage application period and a period other than the reverse bias voltage application period, erroneous light emission of the light emitting element due to the application of reverse bias voltage may be prevented.

Still further, when a thin film transistor of IGZO (InGaZnO) is used as the drive transistor, reversible threshold voltage shift of the thin film transistor of IGZO may be used. That is, the threshold voltage of the thin film transistor of IGZO may also be shifted by the voltage stress due to the application of gate voltage, but unlike an amorphous silicon thin film transistor, the threshold voltage returns to the initial value by applying zero bias. The use of this property allows the threshold voltage to be returned to the initial value, for example, when a black screen is displayed or during a non-display period, such as when power is turned OFF, so that the threshold voltage shift may be prevented.

DESCRIPTION OF THE PREFERRED EMBODIMENTS

Figure 1:
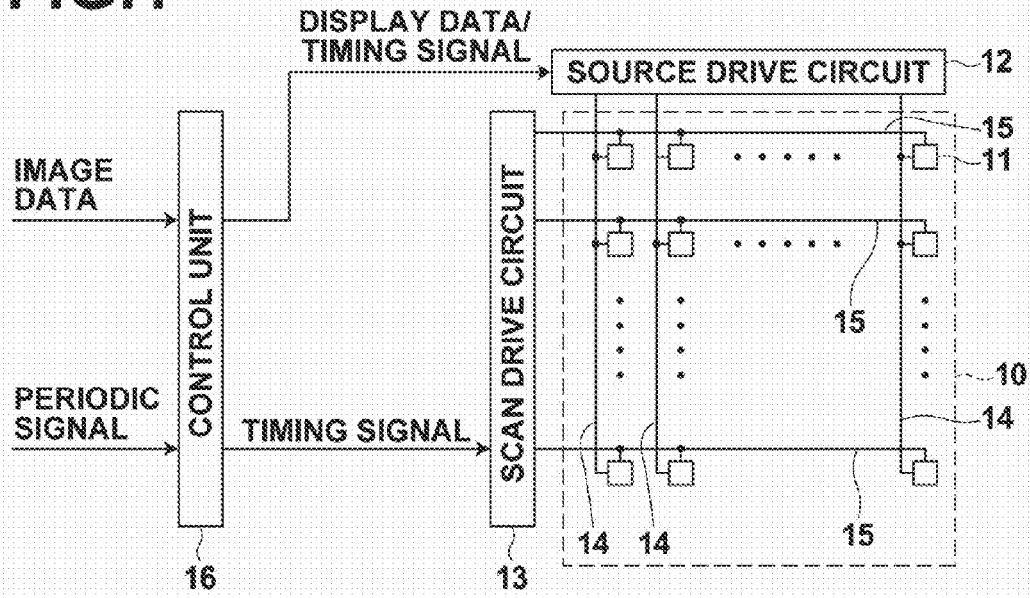
FIG. 1 is a schematic configuration diagram of an organic EL display device incorporating a first embodiment of the display apparatus of the present invention.

Hereinafter, an organic EL display device incorporating a first embodiment of the display apparatus of the present invention will be described with reference to the accompanying drawings. FIG. 1 is a schematic configuration diagram of the organic EL display device incorporating the first embodiment of the display apparatus of the present invention.

As illustrated in FIG. 1, the organic EL display device according to the first embodiment of the present invention includes active matrix substrate 10 having multiple pixel circuits 11 disposed thereon two-dimensionally, each for holding charges according to a data signal outputted from source drive circuit 12 and applying a drive current through an organic EL element according to the amount of charges held therein, source drive circuit 12 that outputs a data signal to each pixel circuit 11 of the active matrix substrate 10, scan drive circuit 13 that outputs a scan signal to each pixel circuit 11 of the active matrix substrate 10, and control unit 16 that outputs display data according to image data and a timing signal based on a synchronization signal to source drive circuit 12, and outputs a timing signal based on the synchronization signal to scan drive circuit 13.

Active matrix substrate 10 further includes multiple data lines 14, each for supplying data signal outputted from source drive circuit 12 to each pixel circuit column and multiple scan lines 15, each for supplying a scan signal outputted from scan drive circuit 13 to each pixel circuit row. Data lines 14 and scan lines 15 are orthogonal to each other, forming a grid pattern. Each pixel circuit 11 is provided adjacent to the intersection between each data line 14 and each scan line 15.

Figure 2:
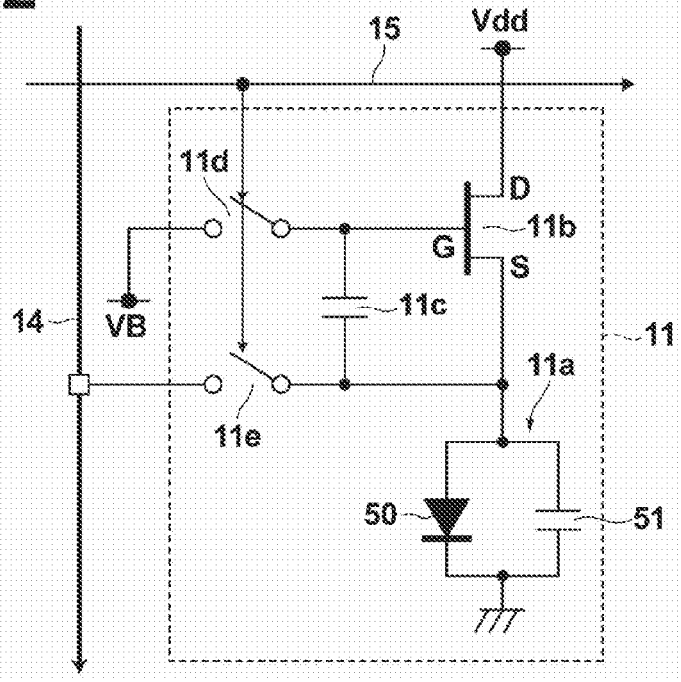
FIG. 2 is a configuration diagram of a pixel circuit of the organic EL display device incorporating the first embodiment of the display apparatus of the present invention.

As illustrated in FIG. 2, each pixel circuit 11 includes organic EL element 11*a*, drive transistor 11*b* with its source terminal S connected to the anode terminal of organic EL element 11*a* to apply a drive current and a detection current, to be described later, through organic EL element 11*a*, capacitor element 11*c* connected between gate terminal G and source terminal S of drive transistor 11*b*, selection transistor 11*d* connected between one end of capacitor element 11*c*/gate terminal G of drive transistor 11*b* and a fixed voltage source, and measuring transistor 11*e* connected between source terminal S of drive transistor 11*b* and data line 14.

Organic EL element 11*a* includes emission section 50 that emits light according to a drive current applied by drive transistor 11*b* and parasitic capacitance 51 of emission section 50. The cathode terminal of organic EL element 11*a* is connected to the ground potential.

Drive transistor 11*b*, selection transistor 11*d*, and measuring transistor 11*e* are n-type thin film transistors. An amorphous silicon thin film transistor or an inorganic oxide thin film transistor may be used as drive transistor 11*b*. As for the inorganic oxide thin film transistor, for example, a thin film transistor of inorganic oxide film made of IGZO (InGaZnO) may be used, but the material is not limited to IGZO and IZO (InZnO) and the like may also be used.

As illustrated in FIG. 2, predetermined fixed voltage Vddx is supplied to drain terminal D of drive transistor 11*b*. Fixed voltage VB is supplied to the terminal, opposite to the terminal connected to gate terminal G of drive transistor 11*b*, of selection transistor 11*d*. The magnitude of fixed voltage VB will be described later.

Based on a timing signal outputted from control unit 16, scan drive circuit 13 sequentially outputs ON-scan signal Vscan (on)/OFF-scan signal Vscan(off) to each scan line 15 for turning ON/OFF selection transistor 11*d* and measuring transistor lie of each pixel circuit 11.

Figure 3:
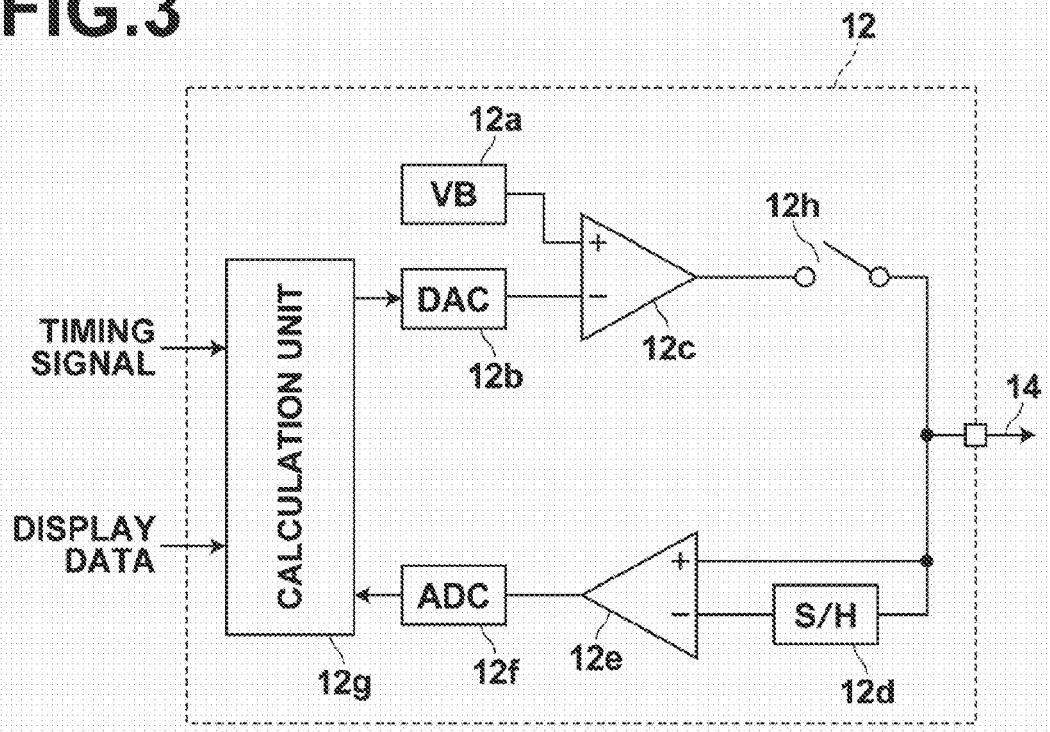
FIG. 3 is a configuration diagram of a source drive circuit of the organic EL display device incorporating the first embodiment of the display apparatus of the present invention.

A detailed configuration diagram of source drive circuit 12 is shown in FIG. 3. Note that source drive circuit 12 includes multiple circuits shown in FIG. 3, that is, FIG. 3 shows one such circuit connected to one data line 14 of active matrix substrate 10.

As illustrated in FIG. 3, source drive circuit 12 includes fixed voltage source 12*a*, D/A converter 12*b*, first differential amplifier 12*c*, sample-and-hold circuit 12*d*, second differential amplifier 12*e*, A/D converter 12*f*, calculation unit 12*g*, and switch element 12*h*.

Fixed voltage source 12*a* supplies fixed voltage VB to the non-inverting input terminal of first differential amplifier 12*c*. Note that fixed voltage VB supplied to the input terminal and fixed voltage VB supplied to gate terminal G of drive transistor 11*b* have the same voltage value. These voltages may be supplied from the same voltage source or from different voltage sources.

D/A converter 12*b* converts first and second measuring gate-source voltages, to be described later, to analog signals, and supplies the analog signals of first and second measuring gate-source voltages to the inverting input terminal of first differential amplifier 12*c*.

First differential amplifier 12*c* calculates and outputs first and second measuring source voltages based on the difference between each of first and second measuring gate-source voltages outputted from D/A converter 12*b* and fixed voltage VB, and calculates and outputs a display source voltage based on the difference between a display gate-source voltage, to be described later, outputted from D/A converter 12*b* and fixed voltage VB.

Sample-and-hold circuit 12*d* has a high impedance input and holds first and second measuring source voltages.

Second differential amplifier 12*e* calculates the differential voltage between each of first and second measuring source voltages held by sample-and-hold circuit 12*d* and the voltage of source terminal S of drive transistor 11*b* when each of first and second measuring source voltages is not supplied to source terminal S of drive transistor 11*b*.

A/D converter 12*f* converts a differential voltage outputted from second differential amplifier 12*e* to a digital signal.

Switch element 12*h* performs switching between first differential amplifier 12*c* and data line 14, and may be formed of, for example, a thin film transistor.

Calculation unit 12*g* calculates a characteristic value of drive transistor 11*b* based on a differential voltage outputted from second differential amplifier 12*e*, based on the characteristic value and display data outputted from control unit 16, calculates a display gate-source voltage to be supplied to drive transistor 11*b*, and outputs the display gate-source voltage to D/A converter 12*b*.

Figure 4:
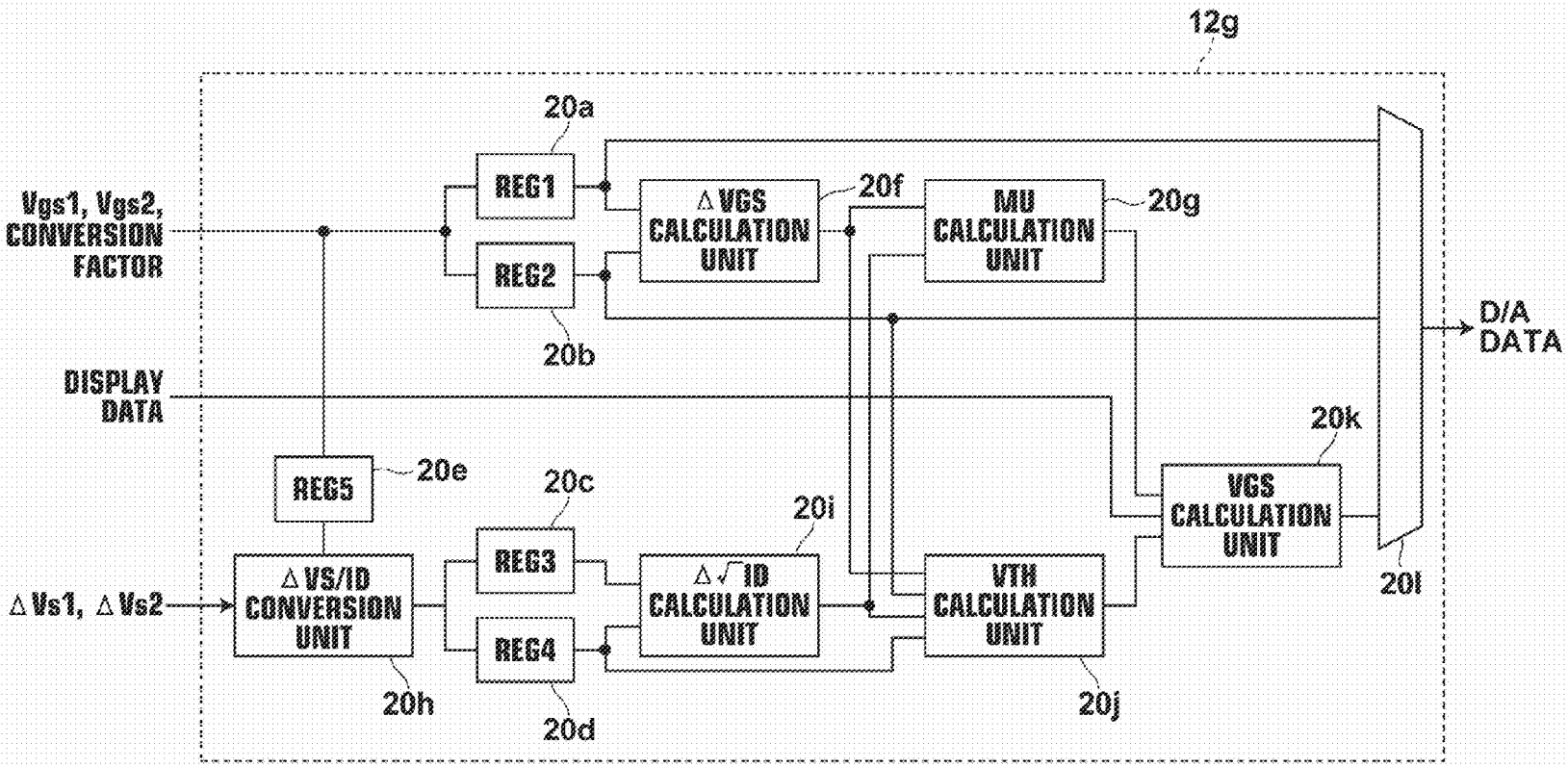
FIG. 4 illustrates detailed configuration of the calculation unit shown in FIG. 3.

A detailed configuration diagram of calculation unit 12*g* is shown in FIG. 4. Calculation unit 12*g* includes first to fifth registers 20*a* to 20*e*, ΔVGS calculation unit 20*f*, MU calculation unit 20*g*, ΔVS/ID conversion unit 20*h*, Δ√ID calculation unit 20*i*, VTH calculation unit 20*j*, VGS calculation unit 20*k*, and I/O unit 201.

First register 20*a* and second register 20*b* hold preset first and second measuring gate-source voltages respectively.

ΔVS/ID conversion unit 20*h* converts a differential voltage outputted from A/D converter 12*f* to a current value, the method of which will be described later.

Fifth register 20*e* holds a preset conversion factor used by ΔVS/ID conversion unit 20*h* for converting the differential voltage to a current value.

Third and fourth registers 20*c* and 20*d* hold first current value and second current value converted by ΔVS/ID conversion unit 20*h* respectively.

Δ√ID calculation unit 20*i* calculates a current variation based on the first current value held by third register 20*c* and the second current value held by fourth register 20*d*.

ΔVGS calculation unit 20*f* calculates a differential gate-source voltage, which is the difference between the first measuring gate-source voltage held by first register 20*a* and the second measuring gate-source voltage held by second register 20*b*.

MU calculation unit 20*g* calculates a mobility based characteristic value of drive transistor 11*b* based on the current variation calculated by Δ√ID calculation unit 20*i* and the differential gate-source voltage calculated by ΔVGS calculation unit 20*f*.

VTH calculation unit 20*j* calculates a threshold voltage based characteristic value of drive transistor 11*b* based on the current variation calculated by Δ√ID calculation unit 20*i* and the differential gate-source voltage calculated by ΔVGS calculation unit 20*f*.

VGS calculation unit 20*k* calculates a display gate-source voltage based on the display data outputted from control unit 16, mobility based characteristic value calculated by MU calculation unit 20*g*, and threshold voltage based characteristic value calculated by VTH calculation unit 20*j*.

I/O unit 201 receives/outputs data from/to A/D converter 12*f*.

Figure 5:
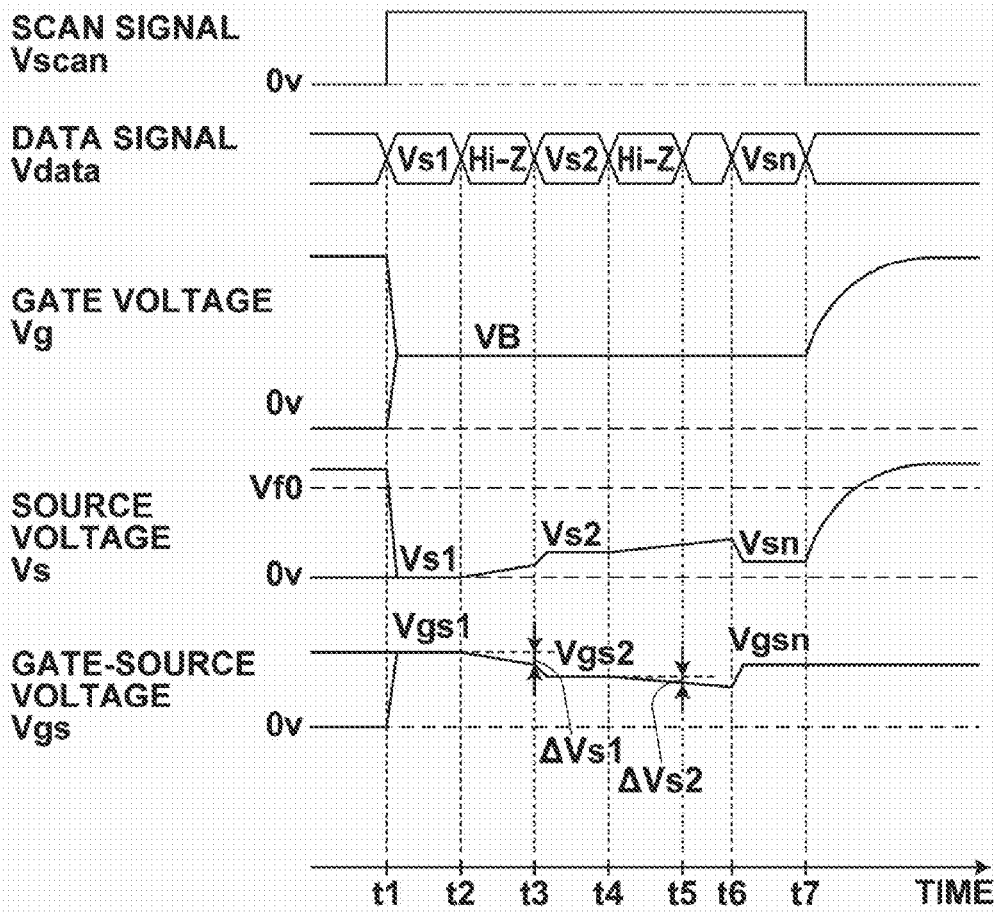
FIG. 5 is a timing chart illustrating an operation of the organic EL display device incorporating the first embodiment of the display apparatus of the present invention.

An operation of the organic EL display device according to the first embodiment will now be described with reference to the timing chart shown in FIG. 5 and FIGS. 6 to 8. FIG. 5 shows voltage waveforms of scan signal Vscan outputted from scan drive circuit 13, data signal Vdata outputted from source drive circuit 12, and gate voltage Vg, source voltage Vs and gate-source voltage Vgs of drive transistor 11*b*.

In the organic EL display device of the present embodiment, pixel circuit rows connected to respective scan lines 15 of active matrix substrate 10 are sequentially selected and predetermined operational steps are performed with respect to each pixel circuit row within a selected period. Here, the operational steps performed in a selected pixel circuit row within a selected period will be described.

First, a certain pixel circuit row is selected by scan drive circuit 13, and an ON-scan signal like that shown in FIG. 5 is outputted to scan line 15 connected to the selected pixel circuit row (time point t1 in FIG. 5).

Figure 6:
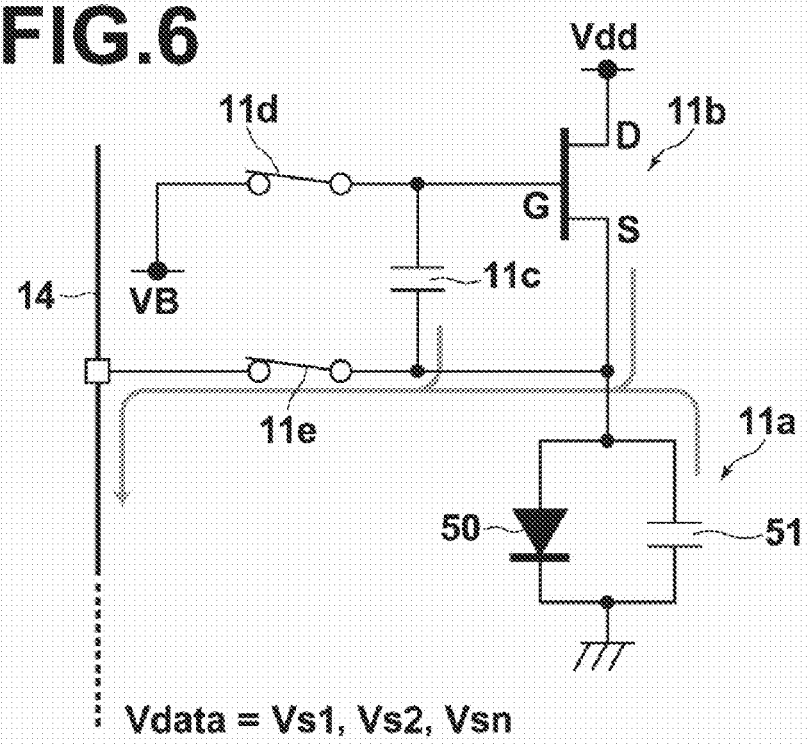
FIG. 6 illustrates a measuring voltage setting of the organic EL display device according to the first embodiment of the present invention.

Then, as illustrated in FIG. 6, selection transistor 11*d* and measuring transistor 11*e* are turned ON in response to the ON-scan signal outputted from scan drive circuit 13, whereby gate terminal G of drive transistor 11*b* is connected to a voltage source supplying fixed voltage VB, and source terminal S of drive transistor 11*b*, one end of capacitor element 11*c* and the anode terminal of organic EL element 11*a* are connected to data line 14.

Thereafter, a first measuring source voltage setting is performed (from time point t1 to time point t2 in FIG. 5, FIG. 6). More specifically, first measuring gate-source voltage Vgs1 preset in first register 20*a* of calculation unit 12*g* of source drive circuit 12 is outputted to D/A converter 12*b* and converted to an analog signal by D/A converter 12*b*, and the analog signal is inputted to first differential amplifier 12*c*. In the mean time, fixed voltage VB outputted from fixed voltage source 12*a* is also inputted to first differential amplifier 12*c*. Then, in first differential amplifier 12*c*, first measuring gate-source voltage Vgs1 is subtracted from fixed voltage VB (same voltage as gate voltage Vg of drive transistor 11*b*), whereby first measuring source voltage Vs1 is calculated.

Then, in response to a timing signal from control unit 16, switch element 12*h* is turned ON, whereby first measuring source voltage Vs1 is outputted to data line 14 as a data signal.

Through the operational steps described above, drive transistor 11*b* of pixel circuit 11 is set in the following manner: gate voltage Vg=VB, source voltage Vs=Vs1, and gate-source voltage Vgs=Vgs1.

Here, when the threshold voltage of drive transistor 11*b* is assumed to be Vth, if Vgs1>Vth, certain current Id1 will flow through drive transistor 11*b*. Further, when the emission threshold voltage of organic EL element 11*a* is assumed to be Vf0, current Id1 flowing through drive transistor 11*b* can be brought into source drive circuit 12 via data line 14, as illustrated in FIG. 6, without causing organic EL element 11*a* to emit light by setting fixed voltage VB so as to satisfy the conditions of formulae below. At this time, charges remaining in capacitor element 11*c* and parasitic capacitance 51 of organic EL element 11*a* are discharged, whereby capacitor element 11*c* and parasitic capacitance 51 are reset.

$$Vs1=VB-Vgs1<Vf0$$

$$VB<Vf0+Vgs1$$

If VB=0 and Vs<0, then organic EL element 11*a* is ensured not to emit light, but the emission transition time of organic EL element 11*a* after completion of the program operation is prolonged, therefore it is preferable that VB is set to a value close to Vf0.

Further, voltage Vs1 of source terminal S of drive transistor 11*b* at this time point is inputted to and held by sample-and-hold circuit 12*d* of source drive circuit 12 via data line 14.

Figure 7:
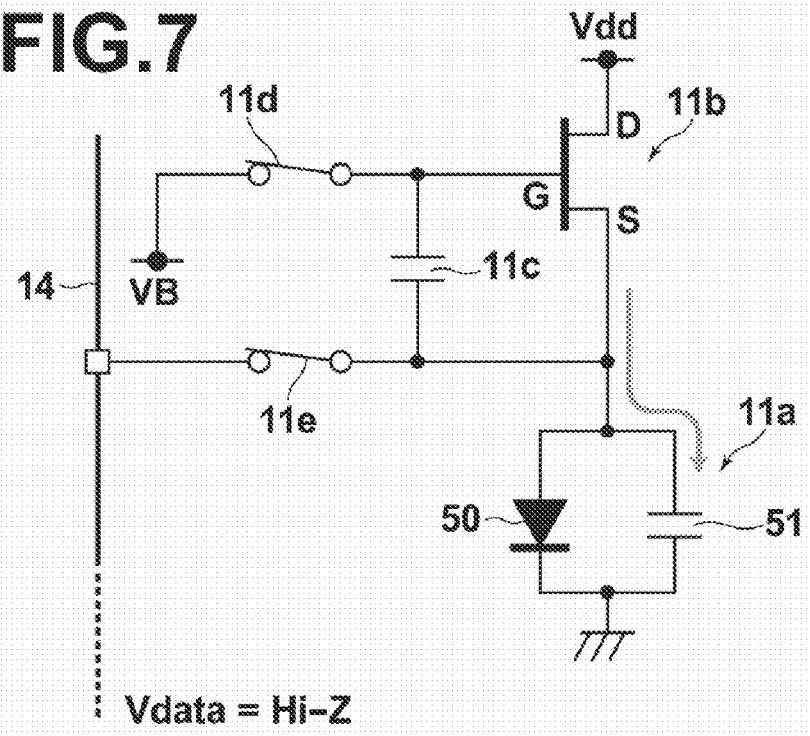
FIG. 7 illustrates a current value detection of the organic EL display device according to the first embodiment of the present invention.

Next, first current value detection is performed (from time point t2 to time point t3 in FIG. 5, FIG. 7). More specifically, switch element 12*h* of source drive circuit 12 is turned OFF in response to a timing signal from control unit 16, whereby first differential amplifier 12*c* is disconnected from data line 14, and data line 14 is turned into a high impedance state.

Then, current Id1 flowing through drive transistor 11*b* by the first measuring source voltage setting described above begins to flow out to parasitic capacitance 51 of organic EL element 11*a*, as illustrated in FIG. 7, since data line 14 is in a high impedance state. Parasitic capacitance 51 is gradually charged by the current and source voltage Vs of drive transistor 11*b* is steadily increased from Vs1, as illustrated in FIG. 5.

Steadily increasing source voltage Vs in the manner as described above is inputted to second differential amplifier 12*e* of source drive circuit 12 via data line 14. Second differential amplifier 12*e* calculates differential voltage ΔVs1, which is the difference between first measuring source voltage Vs1 held by sample-and-hold circuit 12*d* and increased source voltage Vs, and outputs differential voltage ΔVs1 to A/D converter 12*f*. At a time point after a predetermined time from the time when source voltage Vs of drive transistor 11*b* started to increase (from time point t2 to time point t3), A/D converter 12*f* converts inputted differential voltage ΔVs1 to a digital signal, thereby acquiring differential data DVS1.

Here, if the gain of second differential amplifier 12*e* is assumed to be Ks and the resolution of A/D converter 12*f* is assumed to be Ka, differential voltage ΔVs1 takes a value that satisfies the formula below.

$$DVS1=Ks\times\Delta Vs1/Ka$$

Differential data DVS1 outputted from A/D converter 12*f* are inputted to ΔVS/ID conversion unit 20*h* of calculation unit 12*g*. ΔVS/ID conversion unit 20*h* converts inputted DVS1 to first current value Id1. More specifically, when capacitance value of parasitic capacitance 51 of organic EL element 11*a* is assumed to be Cd, and charge time of parasitic capacitance 51 is assumed to be Tc, first current value Id1 can be obtained in the following manner.

$$Id1=Cd\times\Delta Vs1\times Tc=Cd\times Tc\times Ka\times DVS1/Ks$$

Here, Cd×Tc×Ka/Ks in the formula above is preset in fifth register 20*e* as the conversion factor, and ΔVS/ID conversion unit 20*h* calculates first current value Id1 by multiplying inputted differential data DVS1 by the conversion factor preset in fifth register 20*e*.

First current value Id1 calculated by ΔVS/ID conversion unit 20*h* is outputted to and held by third register 20*c*.

Here, it is necessary to set charge time Tc to an appropriate time based on first current value Id1, capacitance value Cd of parasitic capacitance, and the input voltage range of A/D converter 12*f*.

The conversion factor set in fifth register 20*e* includes capacitance value Cd of parasitic capacitance 51, so that the difference in parasitic capacitance 51 with respect to each pixel circuit row is corrected here.

Next, a second measuring source voltage setting is performed (t3 to t4 in FIG. 5, FIG. 6). More specifically, second measuring gate-source voltage Vgs2 preset in second register 20*b* of calculation unit 12*g* of source drive circuit 12 is outputted to D/A converter 12*b*, and, after converted to an analog signal by D/A converter 12*b*, inputted to first differential amplifier 12*c*. In the mean time, fixed voltage VB outputted from fixed voltage source 12*a* is also inputted to first differential amplifier 12*c*. Then, in first differential amplifier 12*c*, second measuring gate-source voltage Vgs2 is subtracted from fixed voltage VB (same voltage as gate voltage Vg of drive transistor 11*b*), whereby second measuring source voltage Vs2 is calculated.

Then, in response to a timing signal from control unit 16, switch element 12*h* is turned ON, whereby second measuring source voltage Vs2 is outputted to data line 14 as a data signal.

Through the operational steps described above, drive transistor 11*b* of pixel circuit 11 is set in the following manner: gate voltage Vg=VB, source voltage Vs=Vs2, and gate-source voltage Vgs=Vgs2.

Here, when the threshold voltage of drive transistor 11*b* is assumed to be Vth, if Vgs2>Vth, certain current Id2 will flow through drive transistor 11*b*. Further, fixed voltage VB needs to satisfy the formula below, as described in the first measuring source voltage setting.

$$VB<Vf0+Vgs2$$

Voltage Vs2 of source terminal S of drive transistor 11*b* at this time point is inputted and held by sample-and-hold circuit 12*d* of source drive circuit 12 via data line 14.

In order to ensure the accuracy of a characteristic value, to be described later, it is important to avoid a low current range for Vgs1 and Vgs2, and it is preferable to use Vgs corresponding to the maximum drive current or average drive current of drive transistor 11*b* as Vgs1 or Vgs2, but there is not any restriction on the magnitude relationship between them.

Next, second current value detection is performed (from time point t4 to time point t5 in FIG. 5, FIG. 7). More specifically, switch element 12*h* is turned OFF in response to a timing signal from control unit 16, whereby first differential amplifier 12*c* is disconnected from data line 14, and data line 14 is turned into a high impedance state.

Then, current Id2 flowing through drive transistor 11*b* by the second measuring source voltage setting described above begins to flow out to parasitic capacitance 51 of organic EL element 11*a*, as illustrated in FIG. 7, since data line 14 is in a high impedance state. Parasitic capacitance 51 is gradually charged by the current and source voltage Vs of drive transistor 11*b* is steadily increased from Vs2, as illustrated in FIG. 5.

Steadily increasing source voltage Vs in the manner as described above is inputted to second differential amplifier 12*e* of source drive circuit 12 via data line 14. Second differential amplifier 12*e* calculates differential voltage ΔVs2, which is the difference between second measuring source voltage Vs2 held by sample-and-hold circuit 12*d* and increased source voltage Vs, and outputs differential voltage ΔVs2 to A/D converter 12*f*. At a time point after a predetermined time (from time point t4 to time point t5) from the time when source voltage Vs of drive transistor 11*b* started to increase, A/D converter 12*f* converts inputted differential voltage ΔVs2 to a digital signal, thereby acquiring differential data DVS2.

Differential data DVS2 outputted from A/D converter 12*f* are inputted to ΔVS/ID conversion unit 20*h* of calculation unit 12*g*. ΔVS/ID conversion unit 20*h* converts inputted DVS2 to second current value Id2. More specifically, ΔVS/ID conversion unit 20*h* obtains second current value Id2 by calculating the formula below using the conversion factor set in fifth register 20*e*, as in the first current value detection.

$$Id2=Cd\times Tc\times Ka\times DVS2/Ks$$

Second current value Id2 calculated by ΔVS/ID conversion unit 20*h* is outputted to and held by fourth register 20*d*.

Thereafter, a characteristic value calculation is performed (from time point t5 to time point t6 in FIG. 5). More specifically, using first measuring gate-source voltage Vgs1 set in first register 20*a*, second measuring gate-source voltage Vgs2 set in second register 20*b*, first current value Id1 set in third register 20*c*, and second current value Id2 set in fourth register 20*d*, threshold voltage based characteristic value VTH of drive transistor 11*b* and mobility based characteristic value MU of drive transistor 11*b* are calculated.

First, Vgs1 set in first register 20*a* and Vgs2 set in second register 20*b* are outputted to ΔVGS calculation unit 20*f*. Then, ΔVGS calculation unit 20*f* calculates differential gate-source voltage ΔVGS by subtracting Vgs2 from Vgs1.

In the mean time, Id1 set in third register 20*c* and Id2 set in fourth register 20*d* are outputted to Δ√ID calculation unit 20*i*. Then, Δ29 ID calculation unit 20*i* obtains current variation Δ√ID by calculating the formula below.

$$\Delta\sqrt{ID}=\sqrt{Id1}-\sqrt{Id2}$$

Then, ΔVGS calculated by ΔVGS calculation unit 20*f* and Δ√ID calculated by Δ√ID calculation unit 20*i* are inputted to MU calculation unit 20*g*, and MU calculation unit 20*g* obtains mobility based characteristic value MU by calculating the formula below.

$$MU=(\Delta\sqrt{ID})^2/(\Delta VGS)^2$$

Further, ΔVGS, Δ√ID, Vgs1 set in first register 20*a*, and Id1 set in third register 20*c* are inputted to VTH calculation unit 20*j*, and VTH calculation unit 20*j* obtains threshold voltage based characteristic value VTH by calculating the formula below.

$$VTH=-b/a$$

where, $$a=\Delta\sqrt{ID}/\Delta VGS \text{ and}$$

$$b=\sqrt{Id1}-a\times Vgs1$$

Methods for acquiring the formulae above for calculating mobility based characteristic value MU and threshold voltage based characteristic value VTH will now be described.

First, from the current formula of a thin film transistor in a saturated region, $$Id=(1/2)\times\mu Cox\times(W/L)\times(Vgs-Vth)^2$$

where, μ is the electron mobility, Cox is the gate oxide film capacitance per unit area, W is the gate width, and L is the gate length.

From the formula above, $$(Vgs-Vth)^2=Id/[(1/2)\times\mu\times Cox\times(W/L)]$$

$$(Vgs-Vth)=\sqrt{Id}/\sqrt{[(1/2)\times\mu\times Cox\times(W/L)]}$$

$$Vgs=\sqrt{Id}/\sqrt{[(1/2)\times\mu\times Cox\times(W/L)]}+Vth$$

From the values of Vgs and Id at two points, $$Vgs1=\sqrt{Id1}/\sqrt{[(1/2)\times\mu\times Cox\times(W/L)]}+Vth$$

$$Vgs2=\sqrt{Id2}/\sqrt{[(1/2)\times\mu\times Cox\times(W/L)]}+Vth$$

$$(Vgs1-Vgs2)=[\sqrt{Id1}-\sqrt{Id2}]/\sqrt{[(1/2)\times\mu\times Cox\times(W/L)]}$$

$$\sqrt{[(1/2)\times\mu\times Cox\times(W/L)]}=[\sqrt{Id1}-\sqrt{Id2}]/(Vgs1-Vgs2)$$

$$(1/2)\times\mu\times Cox\times(W/L)=[\sqrt{Id1}-\sqrt{Id2}]^2/(Vgs1-Vgs2)^2$$

$$(1/2)\times\mu\times Cox\times(W/L)=[\Delta Id]^2/(\Delta VGS)^2$$

Here, the gain characteristic of drive transistor 11*b* required for correction is not mobility μ but mobility based characteristic value MU, MU=(½)×μ×Cox×(W/L). Thus, MU=(½)×μ×Cox×(W/L)=$[\Delta Id]^2/(\Delta VGS)^2$.

Threshold voltage based characteristic value VTH is an X-axis tangent to the √Id-Vgs curve, so that $$a=\Delta\sqrt{Id}/\Delta Vgs \text{ and}$$

$$b=\sqrt{Id1}-a\times Vgs1$$

$$VTH=-b/a$$

Maintenance of source voltage Vs of drive transistor 11*b* at the same state as that of the second current value detection during the characteristic value calculation (from time point t5 to time point t6) does not cause any operational problem, but it is preferable to fix source voltage Vs to Vs2 or the like by turning ON switching element 12*h* of source drive circuit 12 in order to reliably prevent erroneous light emission of organic EL element 11*a*.

Next, a display gate-source voltage setting is performed (from time point t5 to time point t6 in FIG. 5). More specifically, display data outputted from control unit 16, characteristic value MU calculated by MU calculation unit 20*g*, and characteristic value VTH calculated by VTH calculation unit 20*j* are inputted to VGS calculation unit 20*k*. Then, VGS calculation unit 20*k* calculates display gate-source voltage Vgsn based on the formula below. In the formula, Idn represents the display data.

$$Idn=MU\times(Vgsn-VTH)^2$$

$$(Vgsn-VTH)^2=Idn/MU$$

$$Vgsn-VTH=\sqrt{(Idn/MU)}$$

$$Vgsn=\sqrt{(Idn/MU)}+VTH$$

Then, Vgsn calculated by VGS calculation unit 20*k* is inputted to D/A converter 12*b* and after converted to an analog signal by D/A converter 12*b*, inputted to the inverting input terminal of first differential amplifier 12*c*. Then, in first differential amplifier 12*c*, fixed voltage VB is added to Vgsn, whereby Vgsn is converted to Vsn. Then, switching element 12*h* is turned ON and Vsn is outputted to data line 14.

Through the operational steps described above, drive transistor 11*b* is set in the following manner: gate voltage Vg=VB, source voltage Vs=Vsn, and gate-source voltage Vgs=Vgsn.

Figure 8:
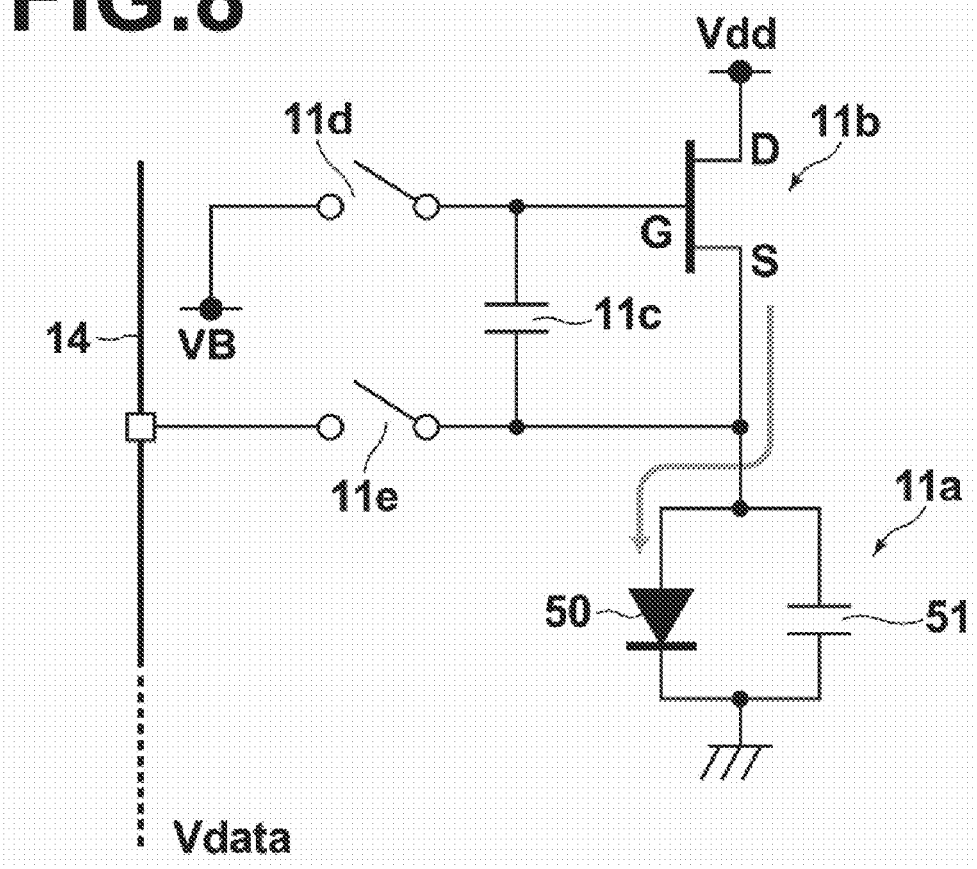
FIG. 8 illustrates emission of the organic EL display device according to the first embodiment.

Thereafter, light emission is performed (time point t7 onward, FIG. 8). More specifically, an OFF-scan signal is outputted from scan drive circuit 13 to each scan line 15 (time point t7 in FIG. 5). Then, as illustrated in FIG. 8, selection transistor 11*d* and measuring transistor lie are turned OFF in response to the OFF-scan signal outputted from scan drive circuit 13, whereby gate terminal G of drive transistor 11*b* is disconnected from the power source supplying fixed voltage VB, and source terminal S of drive transistor 11*b*, one end of capacitor element 11*c* and the anode terminal of organic EL element 11*a* are disconnected from data line 14.

Then, gate-source voltage Vgs of drive transistor 11*b* becomes Vgsn, and drive current Idn flows between the drain and source of drive transistor 11*b* based on the TFT current formula below.

$$Idn=\mu\times Cox\times(W/L)\times(Vgsn-Vth)^2$$

where, μ is the electron mobility, Cox is the gate oxide film capacitance per unit area, W is the gate width, and L is the gate length.

Parasitic capacitance 51 of organic EL element 11*a* is charged by drive current Idn, and source voltage Vs of drive transistor 11*b* is increased, but gate-source voltage Vgsn is maintained by hold voltage Vgsn of capacitor element 11*c*, so that source voltage Vs exceeds, in due time, emission threshold voltage Vf0 of organic EL element 11*a* and light emission under a constant current is performed by emission section 50 of organic EL element 11*a*.

Then, pixel circuit rows are sequentially selected by scan drive circuit 13, and the operational steps from the first measuring source voltage setting to the light emission are performed in each pixel circuit row, whereby a desired image is displayed.

In the organic EL display device according to the first embodiment, first and second measuring gate-source voltages Vgs1, Vgs2 are supplied, then first and second current values Id1, Id2 are detected, and using these values both threshold voltage based characteristic value VTH and mobility based characteristic value are calculated, but an arrangement may be adopted in which only first measuring gate-source voltage Vgs1 is supplied to detect first current value Id1, and using these values either threshold voltage based characteristic value VTH or mobility based characteristic value is calculated. In this case, either one of the characteristic values which is not the calculation target is set to a predetermined fixed value.

Figure 9:
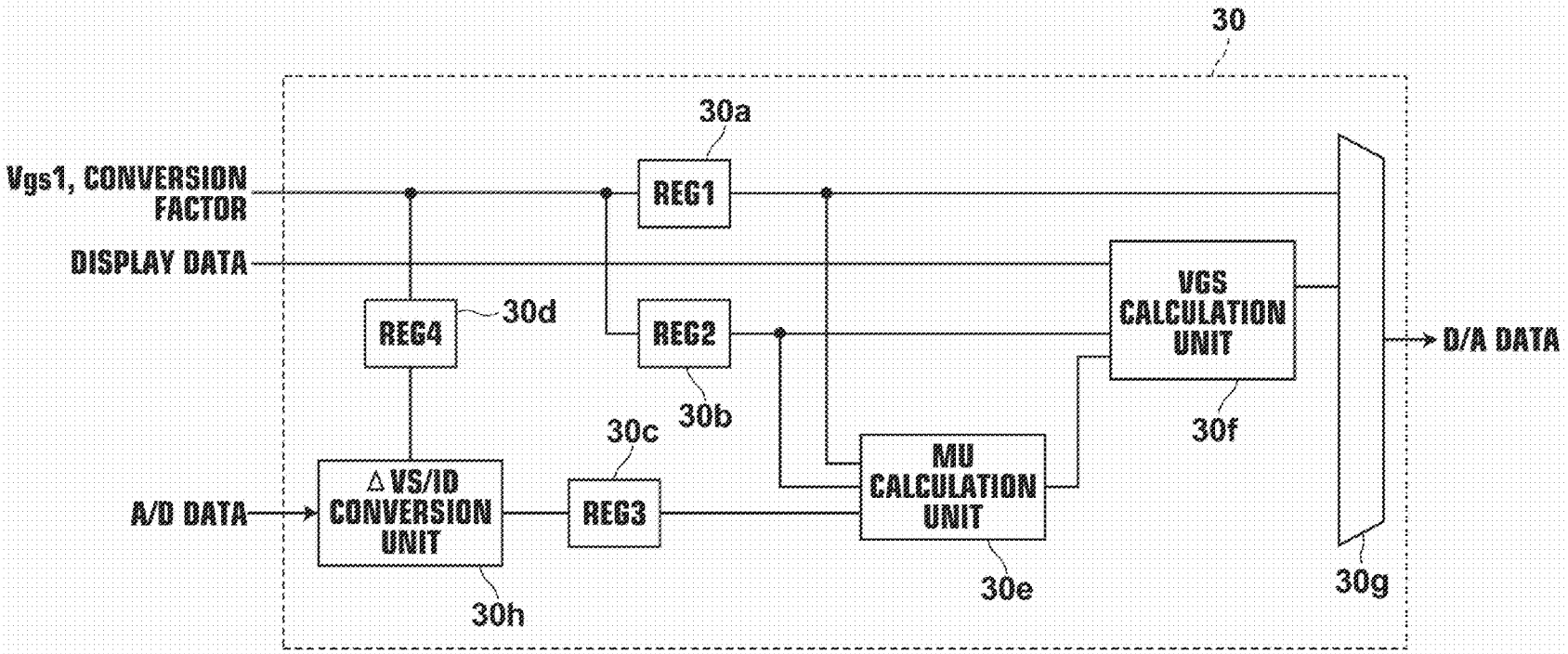
FIG. 9 illustrates a configuration of the calculation unit when only a mobility based characteristic value is calculated.

For example, where threshold voltage based characteristic value VTH is set to a fixed value, and only mobility based characteristic value MU is calculated, the calculation unit of source drive circuit 12 may be configured in the manner shown in FIG. 9. That is, calculation unit 30 is formed of first to fourth registers 30*a* to 30*d*, MU calculation unit 30*e*, ΔVS/ID conversion unit 30*h*, VGS calculation unit 30*f*, and I/O unit 30*g*.

First register 30*a* holds preset first measuring gate-source voltage.

Second register 30*b* holds a preset fixed value for the threshold voltage based characteristic value.

ΔVS/ID conversion unit 30*h* converts a differential voltage outputted from A/D converter 12*f* to a current value.

Fourth register 30*d* holds a preset conversion factor used by ΔVS/ID conversion unit 30*h* for converting the differential voltage to a current value.

Third register 30*c* holds current value Id1 converted by ΔVS/ID conversion unit 30*h*.

MU calculation unit 30*e* calculates a mobility based characteristic value of drive transistor 11*b* based on first current value Id1 held by third register 30*c*, first measuring gate-source voltage Vgs1 set in first register 30*a*, and threshold voltage based characteristic value VTH set in second register 30*b*.

VGS calculation unit 30*f* calculates a display gate-source voltage based on display data outputted from control unit 16, mobility based characteristic value calculated by MU calculation unit 30*e*, and threshold voltage based characteristic value set in second register 30*b*.

The operational steps of a display device having calculation unit 30 configured in the manner as described above are identical to those of the display device according to the first embodiment from the first measuring source voltage setting to the first current value detection.

Thereafter, in the characteristic value calculation, Vgs1 set in first register 30*a*, threshold voltage based characteristic value VTH set in second register 30*b*, and first current value Id1 held by third register 30*c* are inputted to MU calculation unit 30*e*. Then, MU calculation unit 30*e* obtains mobility based characteristic value MU by calculating the formula below.

$$MU=Id1/(Vgs1-VTH)^2$$

Then, the display data outputted from control unit 16, characteristic value MU calculated by MU calculation unit 30*e*, and characteristic value VTH read out from second register 30*b* are inputted to VGS calculation unit 30*f*. Then, VGS calculation unit 30*f* calculates display gate-source voltage Vgsn based on the formula below. In the formula, Idn represents the display data.

$$Vgsn=\sqrt{(Idn/MU)}+VTH$$

Figure 10:
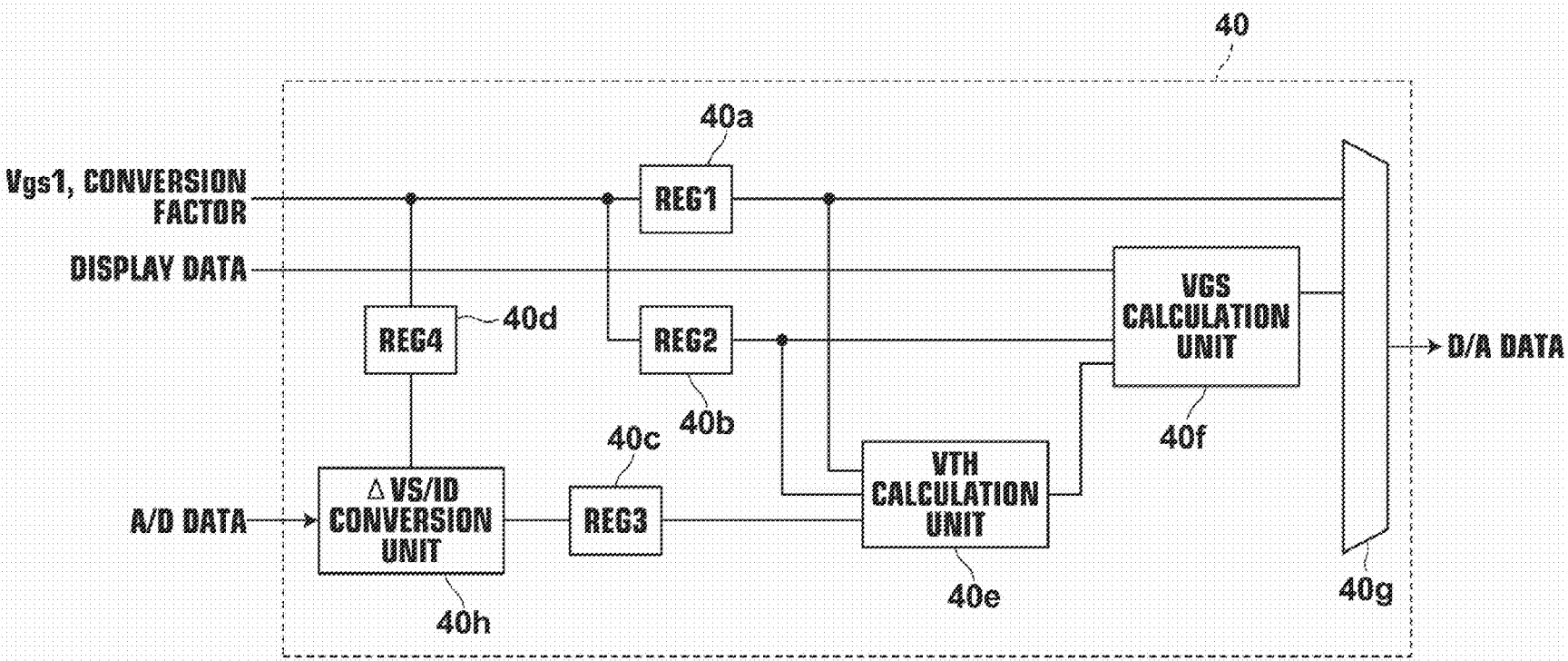
FIG. 10 illustrates a configuration of the calculation unit when only a threshold voltage based characteristic value is calculated.

The operational steps after the calculation of display gate-source voltage Vgsn are identical to those of the first embodiment.

Where mobility based characteristic value MU is set to a fixed value and only threshold voltage based characteristic value VTH is calculated, the calculation unit of source drive circuit 12 may be configured in the manner shown in FIG. 10. That is, calculation unit 40 is formed of first to fourth registers 40*a* to 40*d*, VTH calculation unit 40*e*, ΔVS/ID conversion unit 40*h*, VGS calculation unit 40*f*, and I/O unit 40*g*.

First register 40*a* holds preset first measuring gate-source voltage.

Second register 40*b* holds a preset fixed value for the mobility based characteristic value.

ΔVS/ID conversion unit 40*h*, third and fourth registers 40*c*, 40*d* are identical to those shown in FIG. 9.

VTH calculation unit 40*e* calculates a threshold voltage based characteristic value of drive transistor 11*b* based on first current value Id1 held by third register 40*c*, first measuring gate-source voltage Vgs1 set in first register 40*a*, and mobility based characteristic value MU set in second register 40*b*.

VGS calculation unit 40*f* calculates a display gate-source voltage based on the display data outputted from control unit 16, threshold voltage based characteristic value calculated by VTH calculation unit 40*e*, and mobility based characteristic value set in second register 40*b*.

The operational steps of a display device having calculation unit 40 configured in the manner as described above are identical to those of the display device according to the first embodiment from the first measuring source voltage setting to the first current value detection.

Thereafter, in the characteristic value calculation, Vgs1 set in first register 40*a*, mobility based characteristic value MU set in second register 40*b*, and first current value Id1 held by third register 40*c* are inputted to VTH calculation unit 40*e*. Then, VTH calculation unit 40*e* obtains threshold voltage based characteristic value VTH by calculating the formula below.

$$VTH=Vgs1-\sqrt{(Id1/MU)}$$

Then, the display data outputted from control unit 16, characteristic value VTH calculated by VTH calculation unit 40*e*, and characteristic value MU read out from second register 40*b* are inputted to VGS calculation unit 40*f*. Then, VGS calculation unit 40*f* calculates display gate-source voltage Vgsn based on the formula below. In the formula, Idn represents the display data.

$$Vgsn=\sqrt{(Idn/MU)}+VTH$$

The operational steps after the calculation of display gate-source voltage Vgsn are identical to those of the first embodiment.

Next, an organic EL display device incorporating a second embodiment of the display apparatus of the present invention will be described.

In the organic EL display device according to the first embodiment, first current value Id1 and second current value Id2 are measured with respect to each pixel circuit 11 in each pixel circuit row during the program operation period of each pixel circuit row to calculate characteristic values, thereby eliminating the need to provide a memory for storing characteristic values of all pixel circuits 11. But characteristics of drive transistors 11*b* do not change all of a sudden, thus it may not be necessarily required to calculate and update characteristic values of all pixel circuits 11 in each pixel circuit row during each program operation period.

Consequently, in the organic EL display device according to the second embodiment, characteristic values are calculated and updated only for some of pixel circuits 11 in each pixel circuit row during one program operation period of each pixel circuit row, and characteristic values updated in the previous program operation period are used for the rest of pixel circuits 11 in each pixel circuit row.

Figure 11:
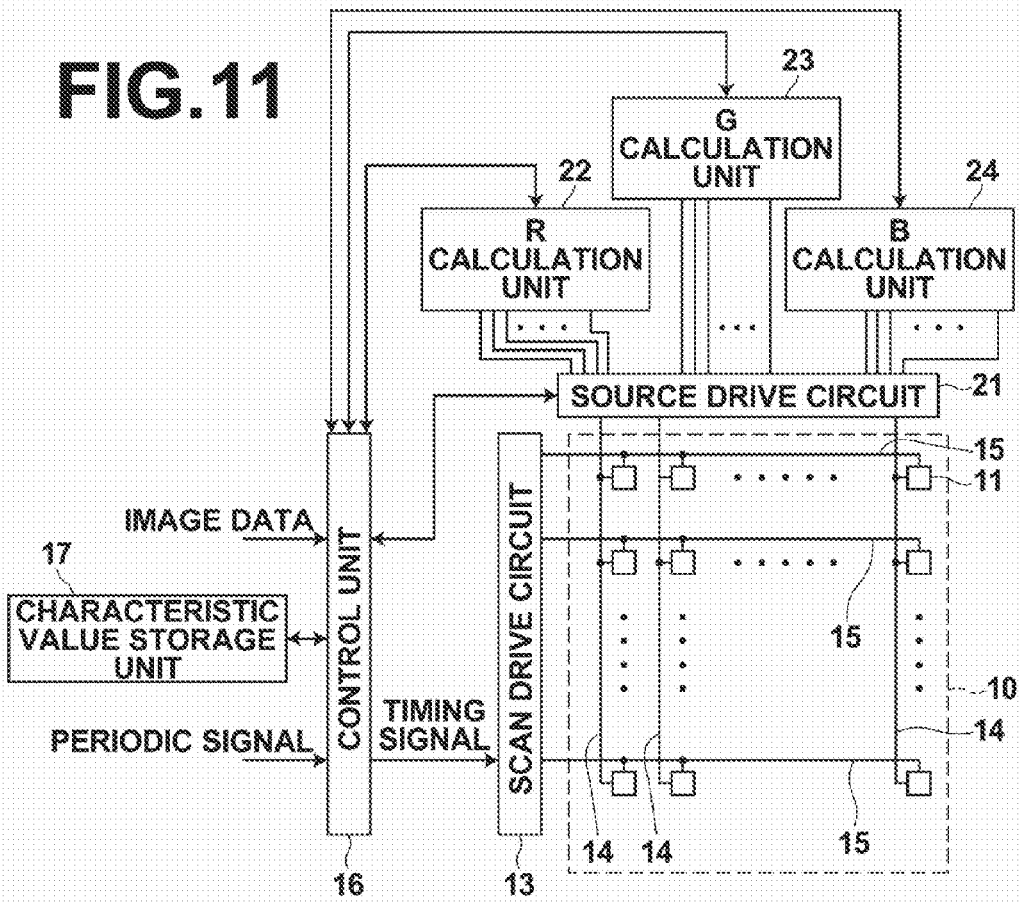
FIG. 11 is a schematic configuration diagram of an organic EL display device incorporating a second embodiment of the display apparatus of the present invention.

A schematic configuration diagram of the organic EL display device according to the second embodiment is shown in FIG. 11.

Figure 12:
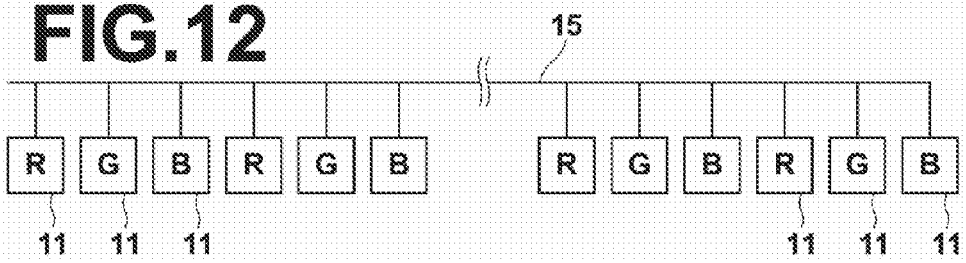
FIG. 12 illustrates the arrangement of R, G, and B pixel circuits of the organic EL display device incorporating the second embodiment of the display apparatus of the present invention.

In the organic EL display device according to the second embodiment, characteristic value memory 17 for storing characteristic values of all pixel circuits is further attached to control unit 16, as shown in FIG. 11. Further, in the organic EL display device according to the first embodiment, calculation units 12*g* are provided as many as pixel circuit rows (number of data lines 14) in source drive circuit 12, while in the organic EL display device according to the second embodiment, only the following three calculation units are provided: R calculation unit 22 for calculating a characteristic value of R (red) pixel circuit 11; G calculation unit 23 for calculating a characteristic value of G (green) pixel circuit 11; and B calculation unit 24 for calculating a characteristic value of B (blue) pixel circuit 11. Other structures including that of the pixel circuit are identical to those of the organic EL display device according to the first embodiment. Therefore, the description will be made mainly for different configurations. Note that R pixel circuit 11, G pixel circuit 11, and B pixel circuit 11 are repeatedly disposed in this order on active matrix substrate 10 in a direction (direction in which scan wire 15 extends) orthogonal to a scan direction (direction in which data line 14 extends), as illustrated in FIG. 12.

Figure 13:
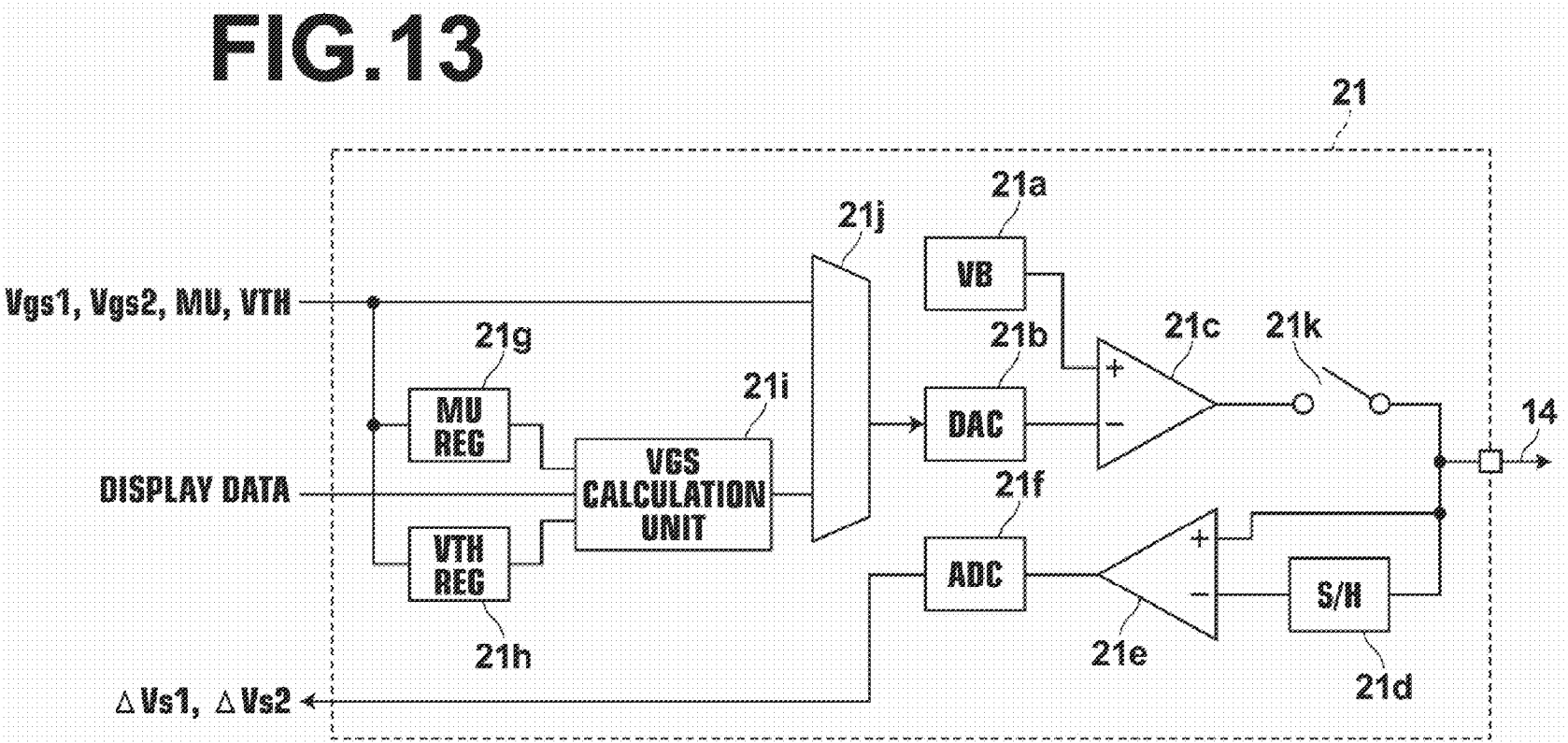
FIG. 13 illustrates a configuration of a source drive circuit of the organic EL display device incorporating the second embodiment of the display apparatus of the present invention.

A detailed configuration diagram of source drive circuit 21 is shown in FIG. 13. Note that source drive circuit 21 includes multiple circuits shown in FIG. 13, that is, FIG. 13 shows one such circuit connected to one data line 14 of active matrix substrate 10.

As illustrated in FIG. 13, source drive circuit 21 includes fixed voltage source 21*a*, D/A converter 21*b*, first differential amplifier 21*c*, sample-and-hold circuit 21*d*, second differential amplifier 21*e*, A/D converter 21*f*, MU register 21*g*, VTH register 21*h*, VGS calculation unit 21*i*, I/O unit 21*j*, and switch element 21*k*.

Fixed voltage source 21*a*, D/A converter 21*b*, first differential amplifier 21*c*, sample-and-hold circuit 21*d*, second differential amplifier 21*e*, A/D converter 21*f*, and switch element 21*k* are identical to those of the organic EL display device according to the first embodiment.

MU register 21*g* holds characteristic value MU calculated by R calculation unit 22, G calculation unit 23, and B calculation unit 24 or characteristic value MU read out from characteristic value memory 17.

VTH register 21*h* holds characteristic value VTH calculated by R calculation unit 22, G calculation unit 23, and B calculation unit 24 or characteristic value VTH read out from characteristic value memory 17.

VGS calculation unit 21*i* calculates display gate-source voltage Vgsn based on display data, characteristic value MU, and characteristic value VTH.

R calculation unit 22 calculates a characteristic value of drive transistor 11*b* based on a differential voltage outputted from second differential amplifier 21*e* of source drive circuit 21 and outputs the characteristic value to control unit 16 and source drive circuit 21.

Figure 14:
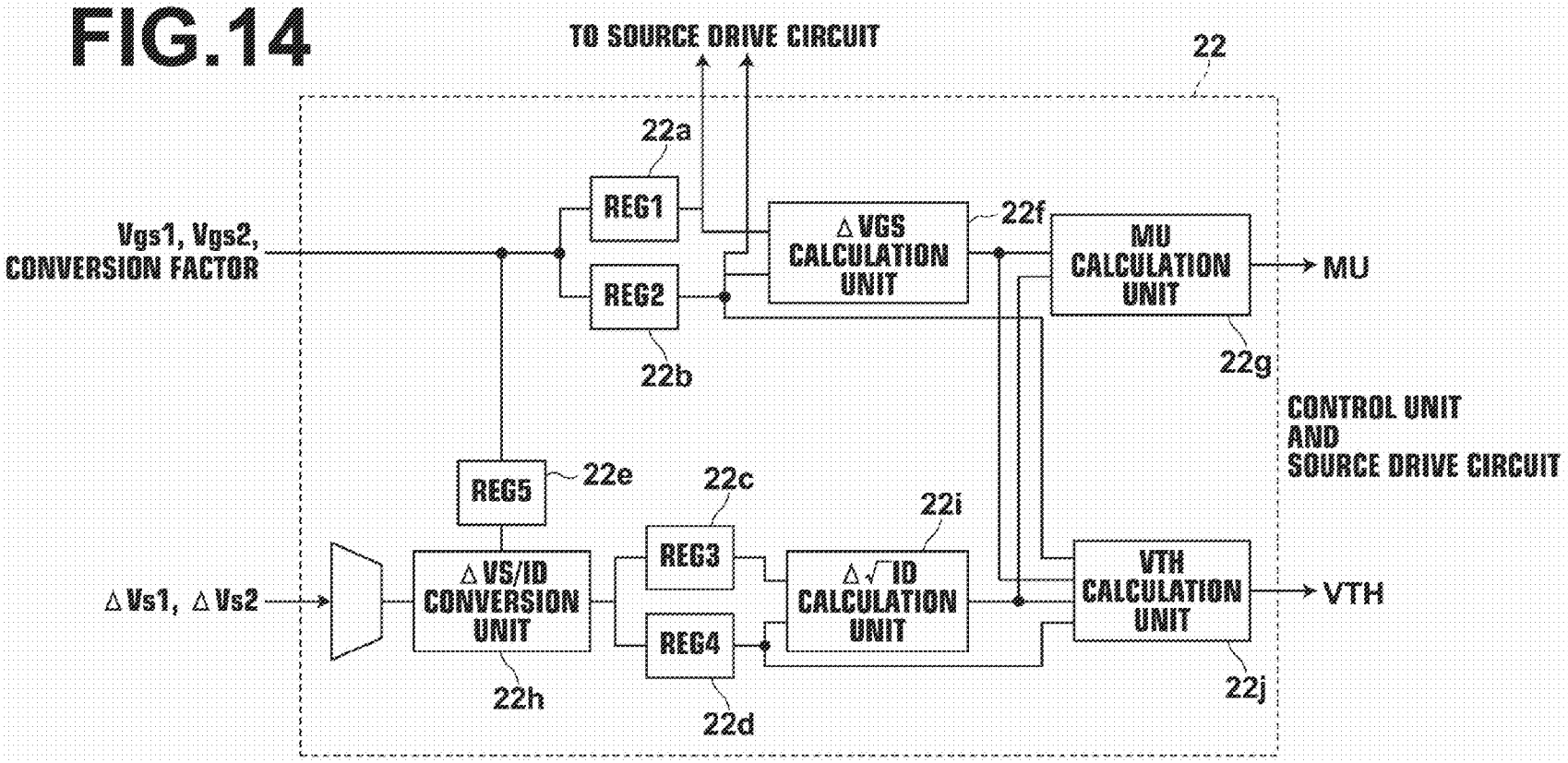
FIG. 14 illustrates a configuration of an R calculation unit of the organic EL display device incorporating the second embodiment of the display apparatus of the present invention.

A detailed configuration diagram of R calculation unit 22 is shown in FIG. 14. R calculation unit 22 includes first to fifth registers 22*a* to 22*e*, ΔVGS calculation unit 22*f*, MU calculation unit 22*g*, ΔVS/ID conversion unit 22*h*, Δ√ID calculation unit 22*i*, and VTH calculation unit 22*j*. These units are identical to those of the organic EL display device according to the first embodiment.

Structures of G calculation unit 23 and B calculation unit 24 are identical to that of R calculation unit 22.

An operation of the organic EL display device according to the second embodiment will now be described. The timing chart and operation of pixel circuit are identical to those of the organic EL display device according to the first embodiment. Therefore, the description will be made with reference to FIG. 5 and FIGS. 6 to 8.

First, a certain pixel circuit row is selected by scan drive circuit 13, and an ON-scan signal like that shown in FIG. 5 is outputted to scan line 15 connected to the selected pixel circuit row (time point t1 in FIG. 5).

Then, as illustrated in FIG. 6, selection transistor 11*d* and measuring transistor lie are turned ON in response to the ON-scan signal outputted from scan drive circuit 13, whereby gate terminal G of drive transistor 11*b* is connected to a voltage source supplying fixed voltage VB, and source terminal S of drive transistor 11*b*, one end of capacitor element 11*c* and the anode terminal of organic EL element 11*a* are connected to data line 14.

Then, as in the organic EL display device according to the first embodiment, first measuring source voltage setting, first current value detection, second measuring source voltage setting, and second current value detection are performed. In the organic EL display device according to the first embodiment, the operational steps described above are performed with respect to each pixel circuit 11 in the selected pixel circuit row, while in the present embodiment, the operational steps described above are performed with respect to three pixel circuits in the selected pixel circuit row, namely, R pixel circuit 11, G pixel circuit 11, and B pixel circuit 11.

First, a first measuring source voltage setting is performed (from time point t1 to time point t2 in FIG. 5, FIG. 6). More specifically, first measuring gate-source voltage Vgs1 preset in first register 22*a* of R calculation unit 22 is outputted to D/A converter 21*b* of source drive circuit 21 and converted to an analog signal by D/A converter 21*b*, and the analog signal is inputted to first differential amplifier 21*c*. In the mean time, fixed voltage VB outputted from fixed voltage source 21*a* is also inputted to first differential amplifier 21*c*. Then, in first differential amplifier 21*c*, first measuring gate-source voltage Vgs1 is subtracted from fixed voltage VB, whereby first measuring source voltage Vs1 is calculated.

Then, in response to a timing signal from control unit 16, switch element 21*k* is turned ON, whereby first measuring source voltage Vs1 is outputted to data line 14 as a data signal.

Through the operational steps described above, drive transistor 11*b* of R pixel circuit 11 is set in the following manner: gate voltage Vg=VB, source voltage Vs=Vs1, and gate-source voltage Vgs=Vgs1.

This causes current Id1 to flow through drive transistor 11*b*, and current Id1 is brought into source drive circuit 21 via data line 14. At this time, charges remaining in capacitor element 11*c* and parasitic capacitance 51 of organic EL element 11*a* are discharged, whereby capacitor element 11*c* and parasitic capacitance 51 are reset.

Further, voltage Vs of source terminal S of drive transistor 11*b* of R pixel circuit 11 is inputted to and held by sample-and-hold circuit 21*d* of source drive circuit 21 via data line 14.

Next, first current value detection is performed (from time point t2 to time point t3 in FIG. 5, FIG. 7). More specifically, switch element 21*k* of source drive circuit 21 is turned OFF in response to a timing signal from control unit 16, whereby first differential amplifier 21*c* is disconnected from data line 14, and data line 14 is turned into a high impedance state.

Then, current Id1 flowing through drive transistor 11*b* by the first measuring source voltage setting described above begins to flow out to parasitic capacitance 51 of organic EL element 11*a*, as illustrated in FIG. 7, since data line 14 is in a high impedance state. Parasitic capacitance 51 is gradually charged by the current and source voltage Vs of drive transistor 11*b* is steadily increased from Vs1, as illustrated in FIG. 5.

Steadily increasing source voltage Vs in the manner as described above is inputted to second differential amplifier 21*e* of source drive circuit 21 via data line 14. Second differential amplifier 21*e* calculates differential voltage ΔVs1, which is the difference between first measuring source voltage Vs1 held by sample-and-hold circuit 21*d* and increased source voltage Vs, and outputs differential voltage ΔVs1 to A/D converter 21*f*. At a time point after a predetermined time from the time when source voltage Vs of drive transistor 11*b* started to increase (from time point t2 to time point t3), A/D converter 21*f* converts inputted differential voltage ΔVs1 to a digital signal, thereby acquiring differential data DVS1.

Then, differential data DVS1 outputted from A/D converter 21*f* are inputted to ΔVS/ID conversion unit 22*h* of R calculation unit 22. ΔVS/ID conversion unit 22*h* calculates first current value Id1 by multiplying inputted differential data DVS1 by the conversion factor set in fifth register 22*e*.

First current value Id1 calculated by ΔVS/ID conversion unit 22*h* is outputted to and held by third register 22*c*.

Next, a second measuring source voltage setting is performed (t3 to t4 in FIG. 5, FIG. 6). More specifically, second measuring gate-source voltage Vgs2 preset in second register 22*b* of R calculation unit 22 is outputted to D/A converter 21*b* of source drive circuit 21 and, after converted to an analog signal by D/A converter 21*b*, inputted to first differential amplifier 21*c*. In the mean time, fixed voltage VB outputted from fixed voltage source 21*a* is also inputted to first differential amplifier 21*c*. Then, in first differential amplifier 21*c*, second measuring gate-source voltage Vgs2 is subtracted from fixed voltage VB, whereby second measuring source voltage Vs2 is calculated.

Then, in response to a timing signal from control unit 16, switch element 21*k* is turned ON, whereby second measuring source voltage Vs2 is outputted to data line 14 as a data signal.

Through the operational steps described above, drive transistor 11*b* of R pixel circuit 11 is set in the following manner: gate voltage Vg=VB, source voltage Vs=Vs2, and gate-source voltage Vgs=Vgs2.

This causes current Id2 to flow through drive transistor 11*b*, and current Id2 is brought into source drive circuit 21 via data line 14. At this time, charges remaining in capacitor element 11*c* and parasitic capacitance 51 of organic EL element 11*a* are discharged, whereby capacitor element 11*c* and parasitic capacitance 51 are reset.

Further, voltage Vs of source terminal S of drive transistor 11*b* of R pixel circuit 11 is inputted to and held by sample-and-hold circuit 21*d* of source drive circuit 21 via data line 14.

Next, second current value detection is performed (from time point t4 to time point t5 in FIG. 5, FIG. 7). More specifically, switch element 21*k* of source drive circuit 21 is turned OFF in response to a timing signal from control unit 16, whereby first differential amplifier 21*c* is disconnected from data line 14, and data line 14 is turned into a high impedance state.

Then, current Id2 flowing through drive transistor 11*b* by the second measuring source voltage setting described above begins to flow out to parasitic capacitance 51 of organic EL element 11*a*, as illustrated in FIG. 7, since data line 14 is in a high impedance state. Parasitic capacitance 51 is gradually charged by the current and source voltage Vs of drive transistor 11*b* is steadily increased from Vs2, as illustrated in FIG. 5.

Steadily increasing source voltage Vs in the manner as described above is inputted to second differential amplifier 21*e* of source drive circuit 21 via data line 14. Second differential amplifier 21*e* calculates differential voltage ΔVs2, which is the difference between second measuring source voltage Vs2 held by sample-and-hold circuit 21*d* and increased source voltage Vs, and outputs differential voltage ΔVs2 to A/D converter 21*f*. At a time point after a predetermined time (from time point t2 to time point t3) from the time when source voltage Vs of drive transistor 11*b* started to increase, A/D converter 21*f* converts inputted differential voltage ΔVs2 to a digital signal, thereby acquiring differential data DVS2.

Differential data DVS2 outputted from A/D converter 21*f* are inputted to ΔVS/ID conversion unit 22*h* of R calculation unit 22. ΔVS/ID conversion unit 22*h* calculates second current value Id2 by multiplying the inputted differential data DVS2 by the conversion factor set in fifth register 22*e*.

Second current value Id2 calculated by ΔVS/ID conversion unit 22*h* is outputted to and held by fourth register 22*d*.

Thereafter, a characteristic value calculation is performed (from time point t5 to time point t6 in FIG. 5). More specifically, using first measuring gate-source voltage Vgs1 set in first register 22*a*, second measuring gate-source voltage Vgs2 set in second register 22*b*, first current value Id1 set in third register 22*c*, and second current value Id2 set in fourth register 22*d*, threshold voltage based characteristic value VTH of drive transistor 11*b* and mobility based characteristic value MU of drive transistor 11*b* are calculated.

First, Vgs1 set in first register 22*a* and Vgs2 set in second register 22*b* are outputted to ΔVGS calculation unit 22*f*. Then, ΔVGS calculation unit 22*f* calculates differential gate-source voltage ΔVGS by subtracting Vgs2 from Vgs1.

In the mean time, Id1 set in third register 22*c* and Id2 set in fourth register 22*d* are outputted to Δ√ID calculation unit 22*i*. Then, Δ√ID calculation unit 22*i* calculates current variation Δ√ID.

Then, ΔVGS calculated by ΔVGS calculation unit 22*f* and Δ√ID calculated by Δ√ID calculation unit 22*i* are inputted to MU calculation unit 22*g*, and MU calculation unit 22*g* calculates mobility based characteristic value MU based on ΔVGS and Δ√ID.

Further, ΔVGS, Δ√ID, Vgs1 set in first register 22*a*, and Id1 set in third register 22*c* are inputted to VTH calculation unit 22*j*, and VTH calculation unit 22*j* calculates threshold voltage based characteristic value VTH based on ΔVGS, Δ√ID, Vgs1 and Id1.

Characteristic value MU and characteristic value VTH with respect to R pixel circuit 11 calculated in the manner described above are outputted to control unit 16 and source drive circuit 21 of R pixel circuit 11. Control unit 16 outputs inputted characteristic value MU and characteristic value VTH to characteristic value memory 17, thereby rewriting and updating the characteristic values of the R pixel circuit. In the mean time, characteristic value MU inputted to source drive circuit 21 of R pixel circuit 11 is held by MU register 21*g* and characteristic value VTH is held by VTH register 21*h*.

With respect to G pixel circuit 11, characteristic value MU and characteristic value VTH are calculated in G calculation unit 23 in the same manner as described above. Then, characteristic value MU and characteristic value VTH for G pixel circuit 11 are outputted to control unit 16 and source drive circuit 21 of G pixel circuit 11. Control unit 16 outputs inputted characteristic value MU and characteristic value VTH to characteristic value memory 17, thereby rewriting and updating the characteristic values of the G pixel circuit. In the mean time, characteristic value MU inputted to source drive circuit 21 of G pixel circuit 11 is held by MU register 21*g* and characteristic value VTH is held by VTH register 21*h*.

Also, with respect to B pixel circuit 11, characteristic value MU and characteristic value VTH are calculated in B calculation unit 24 in the same manner as described above. Then, characteristic value MU and characteristic value VTH for B pixel circuit 11 are outputted to control unit 16 and source drive circuit 21 of B pixel circuit 11. Control unit 16 outputs inputted characteristic value MU and characteristic value VTH to characteristic value memory 17, thereby rewriting and updating the characteristic values of the B pixel circuit. In the mean time, characteristic value MU inputted to source drive circuit 21 of B pixel circuit 11 is held by MU register 21*g* and characteristic value VTH is held by VTH register 21*h*.

With respect to pixel circuits 11 other than the three pixel circuits of R, G, and B for which characteristic values have been calculated in the manner described above, characteristic value MU and characteristic value VTH corresponding to each pixel circuit 11 are read out from characteristic value memory 17 by control unit 16 and inputted to source drive circuit 21 of each pixel circuit 11. Then, characteristic value MU inputted to source drive circuit 21 of each pixel circuit 11 is held by MU register 21*g* and characteristic value VTH is held by VTH register 21*h*.

Next, a display gate-source voltage setting is performed (from time point t5 to time point t6 in FIG. 5). The display gate-source voltage setting is performed with respect to all pixel circuits 11 in a selected pixel circuit row.

More specifically, display data outputted from control unit 16, characteristic value MU held by MU register 21*g*, and characteristic value VTH held by VTH register 21*h* are inputted to VGS calculation unit 21*i*. Then, VGS calculation unit 21*i* calculates display gate-source voltage Vgsn based on characteristic value MU and characteristic value VTH.

Then, Vgsn calculated by VGS calculation unit 21*i* is inputted to D/A converter 21*b* and, after converted to an analog signal by D/A converter 12*b*, inputted to the inverting input terminal of first differential amplifier 21*c*. Then, in first differential amplifier 21*c*, fixed voltage VB is added to Vgsn, whereby Vgsn is converted to Vsn. Then, switching element 21*k* is turned ON and Vsn is outputted to data line 14.

Through the operational steps described above, drive transistor 11*b* is set in the following manner: gate voltage Vg=VB, source voltage Vs=Vsn, and gate-source voltage Vgs=Vgsn.

Thereafter, light emission is performed (time point t7 onward in FIG. 5, FIG. 8). More specifically, an OFF-scan signal is outputted from scan drive circuit 13 to each scan line 15 (time point t7 in FIG. 5). Then, as illustrated in FIG. 8, selection transistor 11*d* and measuring transistor lie are turned OFF in response to the OFF-scan signal outputted from scan drive circuit 13, whereby gate terminal G of drive transistor 11*b* is disconnected from the power source supplying fixed voltage VB, and source terminal S of drive transistor 11*b*, one end of capacitor element 11*c* and the anode terminal of organic EL element 11*a* are disconnected from data line 14.

Then, gate-source voltage Vgs of drive transistor 11*b* becomes Vgsn, and drive current Idn flows between the drain and source of drive transistor 11*b*.

Parasitic capacitance 51 of organic EL element 11*a* is charged by drive current Idn, and source voltage Vs of drive transistor 11*b* is increased, but gate-source voltage Vgsn is maintained by hold voltage Vgsn of capacitor element 11*c*, so that source voltage Vs exceeds, in due time, emission threshold voltage Vf0 of organic EL element 11*a* and light emission under a constant current is performed by emission section 50 of organic EL element 11*a*.

Then, pixel circuit rows are sequentially selected to the last row by scan drive circuit 13, and the operational steps from the first measuring source voltage setting to the light emission are performed in each pixel circuit row, whereby a first image frame is displayed.

Thereafter, when displaying a second image frame, pixel circuit rows are sequentially selected by scan drive circuit 13, and the operational steps from the first measuring source voltage setting to the light emission are performed in each pixel circuit row. Here, however, the target pixel circuits for calculating the characteristic values are changed.

More specifically, when displaying the first image frame, characteristic values are calculated with respect to R, G, and B pixel circuits disposed in the left-most positions in a selected pixel circuit row to update the characteristic values stored in characteristic value memory 17. When displaying the second image frame, R, G, and B pixel circuits adjacent, on the right, to the target R, G, and B pixel circuits used for characteristic value calculation at the time of displaying the first image frame are selected as the target pixel circuits for characteristic value calculation.

Further, when displaying a second image frame, R, G, and B pixel circuits adjacent, on the right, to the target R, G, and B pixel circuits used for characteristic value calculation at the time of displaying the second image frame are selected as the target pixel circuits for characteristic value calculation.

In this way, the target pixel circuits for characteristic value calculation are sequentially shifted to the right for each new image frame. This will result in that characteristic values of all pixel circuits stored in characteristic value memory 17 are updated at the time point when the number of image frames corresponding to all pixel circuits in a pixel circuit row divided by three. For example, for a VGA image of 640×480 pixels (here, three pixel circuits of R, G, and B are assumed to be one pixel) with a frame rate of 60 Hz, the characteristic value updating rate is 640 frames, i.e., 10.7 seconds, which can be said to be fast enough in comparison with the speed of characteristic change in a drive transistor.

In the display device according to the second embodiment, target pixel circuit columns for characteristic value calculation are sequentially changed with respect to each image frame, but target pixel circuit rows for characteristic value calculation may be sequentially changed with respect to each image frame.

Figure 15:
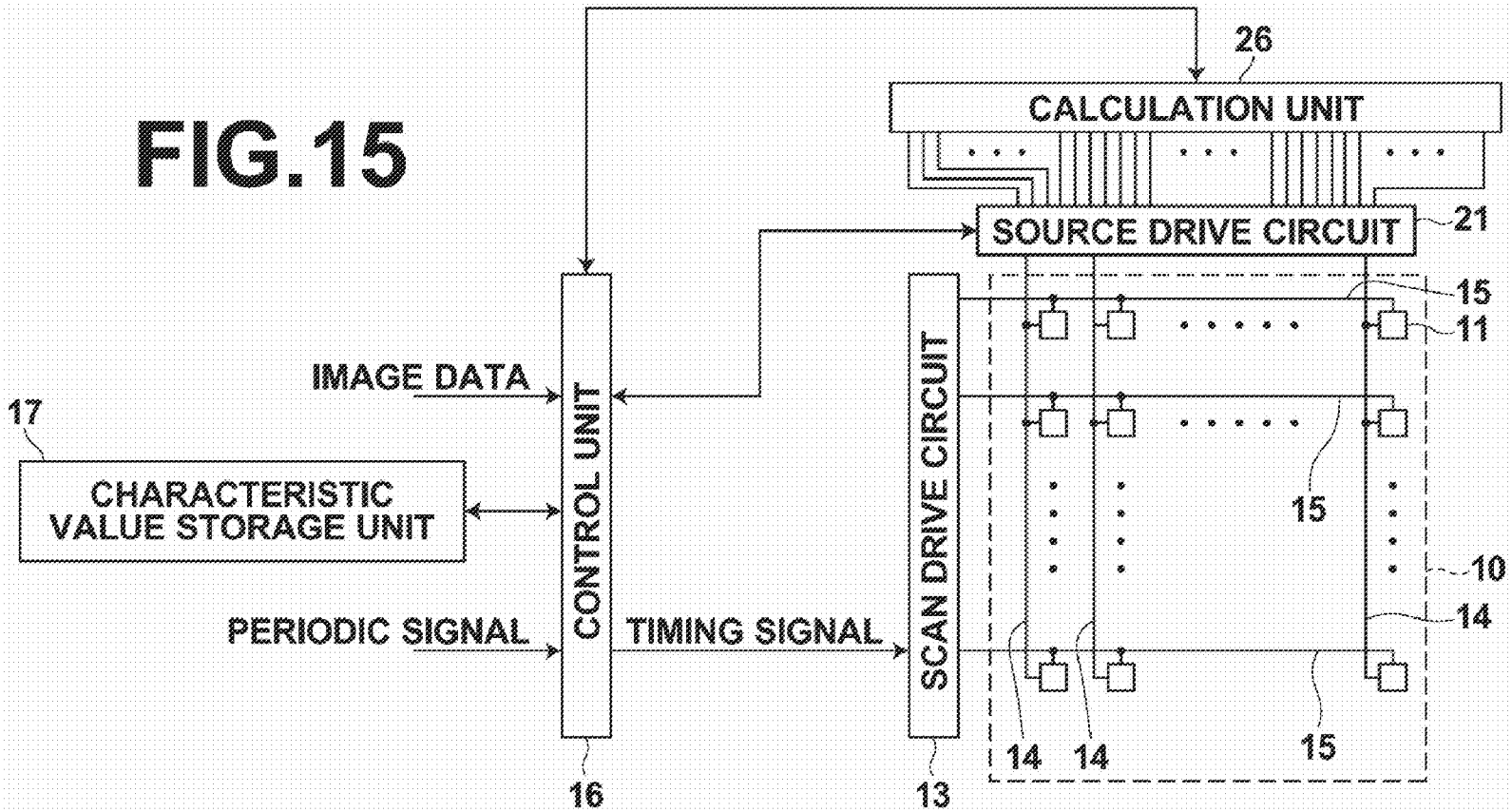
FIG. 15 is a schematic configuration diagram of the organic EL display device when changing target pixel circuit rows for characteristic value calculation.

Schematic configuration for the latter is shown in FIG. 15. As shown in FIG. 15, the configuration differs from that of the second embodiment in the structure for calculation. More specifically, in the second embodiment, only three calculation units, R calculation unit, G calculation unit, and B calculation unit, are provided, while when changing target pixel circuit rows for characteristic value calculation, calculation unit 26, which includes the unit shown in FIG. 16 with respect to each pixel circuit row (each data line), is provided. Other structures are identical to those of the second embodiment.

An operation of the organic EL display device shown in FIG. 15 will be described. The timing chart and operation of pixel circuit are identical to those of the organic EL display device according to the first embodiment. Therefore, the description will be made with reference to FIG. 5 and FIGS. 6 to 8.

First, a first pixel circuit row (uppermost pixel circuit row in FIG. 15) is selected by scan drive circuit 13, and an ON-scan signal like that shown in FIG. 5 is outputted to scan line 15 connected to the pixel circuit row (time point t1 in FIG. 5).

Then, as illustrated in FIG. 6, selection transistor 11*d* and measuring transistor lie are turned ON in response to the ON-scan signal outputted from scan drive circuit 13, whereby gate terminal G of drive transistor 11*b* is connected to a voltage source supplying fixed voltage VB, and source terminal S of drive transistor 11*b*, one end of capacitor element 11*c* and the anode terminal of organic EL element 11*a* are connected to data line 14.

Then, as in the organic EL display device according to the second embodiment, first measuring source voltage setting, first current value detection, second measuring source voltage setting, second current value detection, and characteristic value calculation are performed. In the organic EL display device shown in FIG. 15, the operational steps described above are performed with respect to one of pixel circuit rows from the first to last. First, the operational steps described above are performed with respect to the first pixel circuit row (uppermost pixel circuit row in FIG. 15). Details of the operational steps are identical to those of the second embodiment.

Then, with respect to each pixel circuit in the first pixel circuit row, characteristic value MU and characteristic value VTH are calculated. Characteristic value MU and characteristic value VTH for each pixel circuit are outputted to control unit 16 and source drive circuit 21. Control unit 16 outputs inputted characteristic value MU and characteristic value VTH to characteristic value memory 17, thereby rewriting and updating the characteristic values of each pixel circuit in the first pixel circuit row. In the mean time, characteristic value MU inputted to source drive circuit 21 is held by MU register 21*g* and characteristic value VTH is held by VTH register 21*h*.

Then, with respect to the first pixel circuit row, display gate-source voltage setting and light emission are performed. These operational steps are identical to those of the second embodiment.

Next, a second pixel circuit row (second pixel circuit row from the top in FIG. 15) is selected by scan drive circuit 13, and an ON-scan signal like that shown in FIG. 5 is outputted to scan line 15 connected to the pixel circuit row.

Then, as illustrated in FIG. 6, selection transistor 11*d* and measuring transistor 11*e* are turned ON in response to the ON-scan signal outputted from scan drive circuit 13, whereby gate terminal G of drive transistor 11*b* is connected to a voltage source supplying fixed voltage VB, and source terminal S of drive transistor 11*b*, one end of capacitor element 11*c* and the anode terminal of organic EL element 11*a* are connected to data line 14.

With respect to the second pixel circuit row, first measuring source voltage setting, first current value detection, second measuring source voltage setting, second current value detection, and characteristic value calculation are not performed. That is, for each pixel circuit in the second pixel circuit row, characteristic values stored in characteristic value memory 17 are not updated. Then, characteristic value MU and characteristic value VTH stored in characteristic value memory 17 when selected previously as the target for characteristic value calculation are read out and held by MU register 21*g* and VTH register 21*h* of source drive circuit 21 respectively.

Then, with respect to the second pixel circuit row, display gate-source voltage setting and light emission are performed. These operational steps are identical to those of the first pixel circuit row.

Thereafter, pixel circuit rows are sequentially selected by scan drive circuit 13 from the third pixel circuit row to the final pixel circuit row, and operational steps identical to those of the second pixel circuit row are performed, whereby a first image frame is displayed.

Then, when displaying a second image frame, the target pixel circuit row for characteristic value calculation is changed from the first pixel circuit row to the second pixel circuit row. That is, for the first pixel circuit row, operational steps identical to those performed with respect to the second pixel circuit row onward when the first image frame was displayed are performed. For the second pixel circuit row, operational steps identical to those performed with respect to the first pixel circuit row when the first image frame was displayed are performed.

Further, when displaying a third image frame, the target pixel circuit row for characteristic value calculation is changed from the second pixel circuit row to the third pixel circuit row. That is, for the first and second pixel circuit rows, operational steps identical to those performed with respect to the second pixel circuit row onward when the first image frame was displayed are performed. For the third pixel circuit row, operational steps identical to those performed with respect to the first pixel circuit row when the first image frame was displayed are performed.

In this way, the target pixel circuit rows for characteristic value calculation are sequentially shifted for each new image frame. This will result in that characteristic values of all pixel circuits stored in characteristic value memory 17 are updated at the time point when the number of image frames corresponding to the number of pixel circuit rows is displayed. For example, for a VGA image of 640×480 pixels (here, three pixel circuits of R, G, and B are assumed to be one pixel) with a frame rate of 60 Hz, the characteristic value updating rate is 480 frames, i.e., 8 seconds, which can be said to be fast enough in comparison with the speed of characteristic change in a drive transistor.

As described above, by switching and selecting some of all of pixel circuit rows, from the first to the last, for each new image frame, and acquiring characteristic values with respect to the selected pixel circuit rows, for example, even when a scanning time of all pixel circuit rows is short, such as in a high-resolution panel, a time for acquiring characteristic values of pixel circuits in some of the pixel circuit rows can be ensured, and characteristic values of pixel circuits in all pixel circuit rows can be obtained by changing pixel circuit rows for acquiring characteristic values with respect to each frame.

Further, as described above, when the target pixel circuit columns or pixel circuit rows for calculating characteristic values are sequentially changed for each new image frame, both threshold voltage based characteristic value VTH and mobility based characteristic value MU are not necessarily calculated, and an arrangement may be adopted in which only first measuring gate-source voltage Vgs1 is supplied to detect first current value Id1, and either one of threshold voltage based characteristic value VTH and mobility based characteristic value MU is calculated.

Here, in the organic EL display device according to the first or second embodiment, it is necessary to use an n-type thin film transistor as the drive transistor, and an amorphous silicon thin film transistor can be used as the n-type thin film transistor.

The amorphous silicon thin film transistor, however, has a drawback that the threshold voltage is shifted by gate voltage stress.

In the organic EL display device according to the first or second embodiment, the value of current flowing through drive transistor 11*b* is detected by setting gate voltage Vg of drive transistor 11*b* to fixed voltage VB and changing the source voltage. Therefore, if the shift in threshold voltage of drive transistor 11*b* is large, the source voltage set when detecting the current value becomes small. Consequently, a voltage source that supplies a large negative voltage taking into account a long-term shift in threshold voltage is required. Accordingly, from the viewpoint of power saving, it is desirable to restrict the threshold voltage shift in drive transistor 11*b*.

A method for restricting the threshold voltage shift by applying a reverse bias voltage to the gate terminal of a drive transistor is proposed as described, for example, in Japanese Unexamined Patent Publication No. 2006-227237 (Patent Document 7).

The magnitude of gate voltage applied to the gate terminal of a drive transistor when an image is displayed depends on the image, and the amount of shift in threshold voltage of the drive transistor varies with the magnitude of the gate voltage. The period and magnitude of the reverse bias in the method described in Patent Document 7, however, are common to all pixels, so that the method can not cover the difference in threshold voltage and variation in threshold voltage shift due to an image displayed of each drive transistor. Consequently, once the shift in threshold voltage of the drive transistor starts out due to insufficient reverse bias voltage, the threshold voltage shift advances at an accelerated pace. That is, it is difficult for the method described in Patent Document 7 to prevent the threshold voltage shift of the drive transistor where the displayed image is updated over a long period of time.

Next, an organic EL display device incorporating a third embodiment of the display apparatus of the present invention capable of appropriately preventing the threshold voltage shift in drive transistor described above will be described. The organic EL display device according to the third embodiment is a modification of the organic EL display device according to the first embodiment in which a display image based reverse bias voltage is applied to drive transistor 11*b*.

Figure 16:
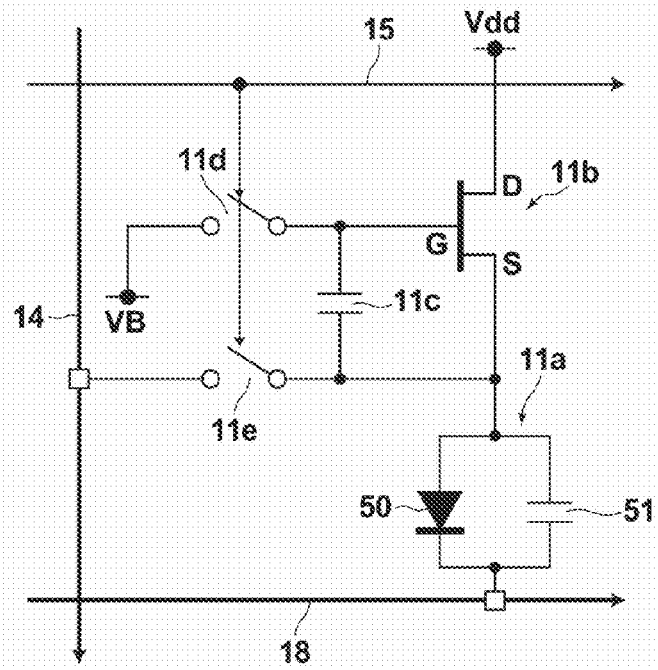
FIG. 16 is a configuration diagram of a pixel circuit of an organic EL display device incorporating a third embodiment of the display apparatus of the present invention.

A configuration diagram of a pixel circuit of the organic EL display device according to the third embodiment is shown in FIG. 16. As illustrated in FIG. 16, common electrode wire 18 is connected to the cathode terminal of organic EL element 11*a* of the pixel circuit of the organic EL display device according to the third embodiment. Other structures of the pixel circuit are identical to those of the organic EL display device according to the first embodiment.

Figure 17:
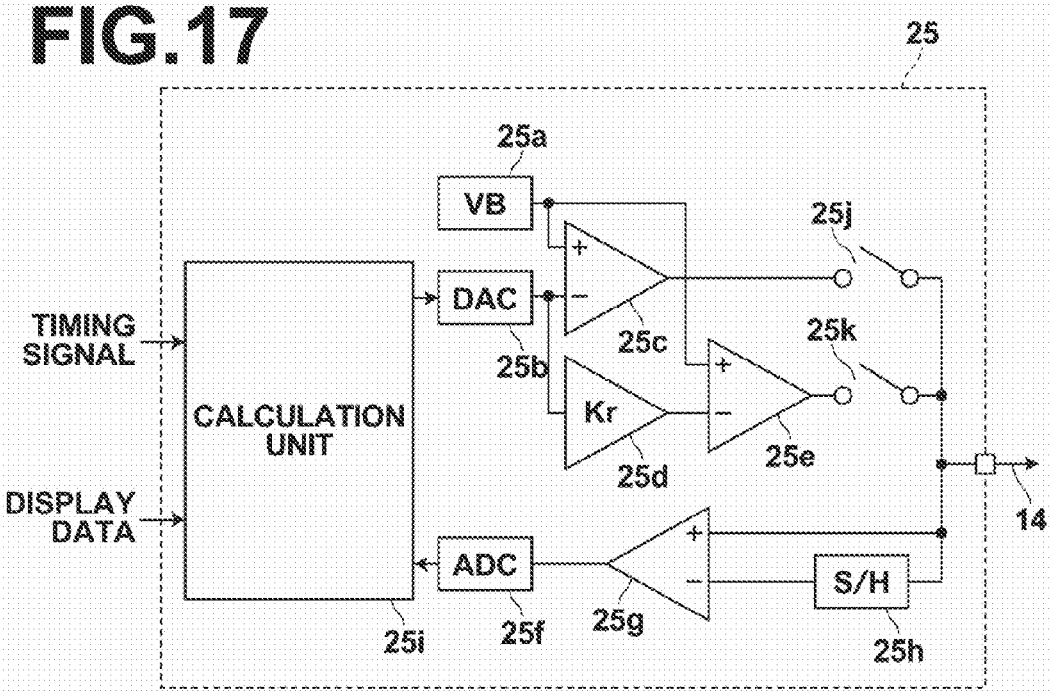
FIG. 17 illustrates a configuration of a source drive circuit of the organic EL display device incorporating the third embodiment of the display apparatus of the present invention.

As illustrated in FIG. 17, source drive circuit 25 of the organic EL display device according to the third embodiment includes fixed voltage source 25*a*, D/A converter 25*b*, first differential amplifier 25*c*, sample-and-hold circuit 25*h*, second differential amplifier 25*g*, A/D converter 25*f*, calculation unit 25*i*, first switch element 25*j*, amplifier 25*d*, third differential amplifier 25*e*, and second switch element 25*k*.

Fixed voltage source 25*a*, D/A converter 25*b*, first differential amplifier 25*c*, sample-and-hold circuit 25*h*, second differential amplifier 25*g*, A/D converter 25*f*, calculation unit 25*i*, and first switch element 25*j* are identical those of the organic EL display device according to the first embodiment.

Amplifier 25*d* multiplies display gate-source voltage Vgsn calculated by VGS calculation unit 20*k* in calculation unit 25*i* by Kr and outputs the multiplied voltage.

Third differential amplifier 25*e* calculates reverse bias voltage Vrv by adding VB to the voltage, Kr×Vgsn, outputted from amplifier 25*d*, and outputs reverse bias voltage Vrv to data line 14.

Second switch element 25*k* establishes or disestablishes the connection between third differential amplifier 25*e* and data line 14 in response to a timing signal based on a synchronization signal outputted from control unit 16.

Other structures are identical to those of the organic EL display device according to the first embodiment.

Figure 18:
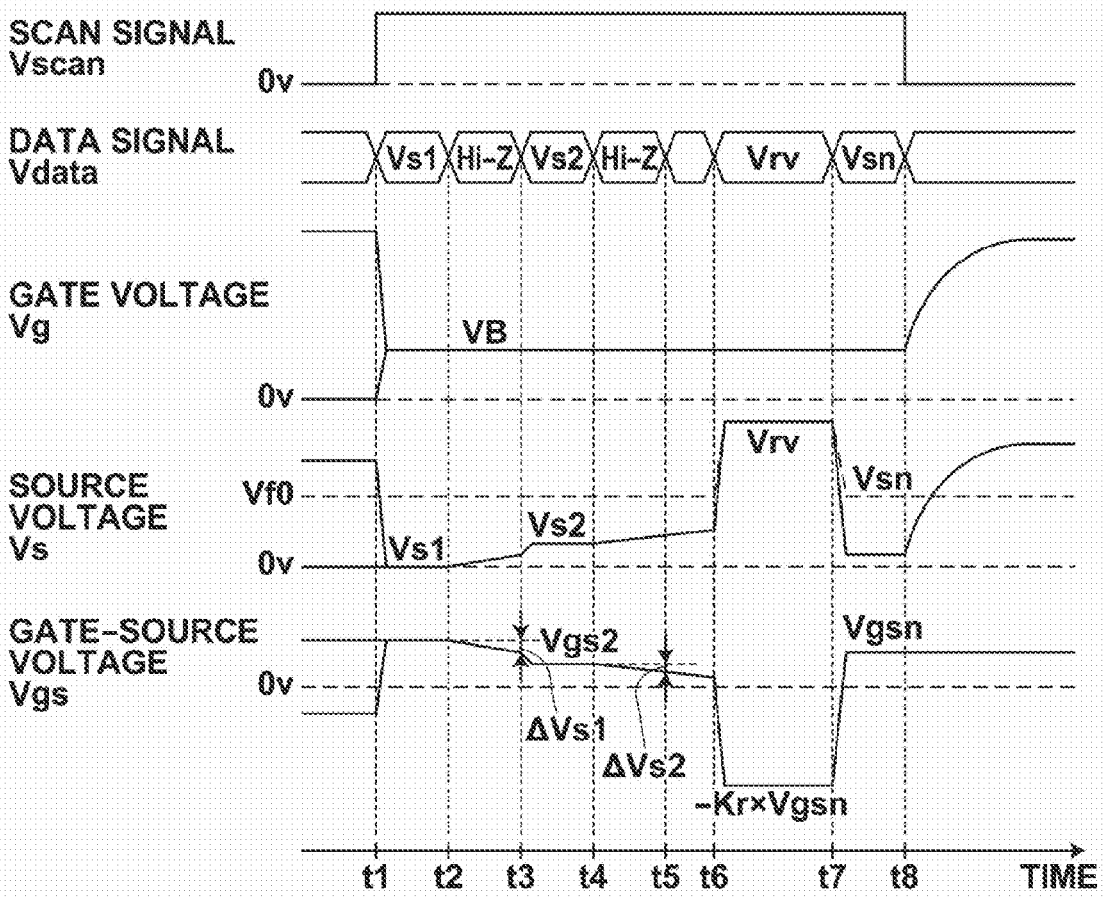
FIG. 18 is a timing chart illustrating an operation of the organic EL display device incorporating the third embodiment of the display apparatus of the present invention.

An operation of the organic EL display device according to the third embodiment will now be described with reference to the timing chart shown in FIG. 18. FIG. 18 shows voltage waveforms of scan signal Vscan outputted from scan drive circuit 13, data signal Vdata outputted from source drive circuit 12, and gate voltage Vg of drive transistor 11*b*, source voltage Vs and gate-source voltage Vgs of drive transistor 11*b*.

As illustrated in the timing chart of FIG. 18, in the organic EL display device according to the third embodiment, reverse bias application (time point t6 to time point t7 in FIG. 18) is performed between characteristic value calculation (time point t5 to time point t6 in FIG. 18) and display gate-source voltage setting (time point t7 to time point t8 in FIG. 18). Other operational steps are identical to those of the organic EL display device according to the first embodiment. Therefore, only the reverse bias application will be described here.

More specifically, the reverse bias application step is performed after characteristic value calculation step in the following manner. That is, display data outputted from control unit 16, characteristic value MU calculated by MU calculation unit 20*g*, and characteristic value VTH calculated by VTH calculation unit 20*j* are inputted to VGS calculation unit 20*k*, and VGS calculation unit 20*k* calculates display gate-source voltage Vgsn based on the display data, characteristic value MU, and characteristic value VTH.

Then, Vgsn calculated by VGS calculation unit 20*k* is inputted to D/A converter 25*b* and, after converted to an analog signal by D/A converter 25*b*, inputted to amplifier 25*d*. In amplifier 25*d*, Vgsn is multiplied by Kr, and Kr×Vgsn is inputted to the inverting input terminal of third differential amplifier 25*e*. Then, in third differential amplifier 25*e*, fixed voltage VB is added to Kr×Vgsn, whereby reverse bias voltage Vrv represented by the formula below is calculated.

$$Vrv=Kr\times Vgsn+VB$$

Then, second switch element 25*k* is turned ON, whereby reverse bias voltage Vrv is outputted from third differential amplifier 25*e* to data line 14 and applied to source terminal S of drive transistor 11*b* of pixel circuit 11. This means that a voltage corresponding to −Kr times of positive voltage Vgsn set at the time of light emission is applied between the gate and source of drive transistor 11*b*, whereby threshold voltage shift prevention effects can be improved greatly.

During the reverse bias application period, the potential of common electrode wire 18, connected to the cathode terminal of organic EL element 11*a* of pixel circuit 11, is changed from 0V to a high voltage (e.g., Vdd). This causes reverse bias voltage Vrv to be applied to source terminal S of drive transistor 11*b* (anode terminal of organic EL element 11*a*), whereby erroneous light emission of organic EL element 11*a* is prevented.

The reverse bias voltage in the organic EL display device according to the third embodiment will now be discussed.

In the organic EL display device according to the third embodiment, voltage stress of drive transistor 11*b* arising from image display is Vgs×Tdsp, in which Tdsp represents display period. When the reverse bias application period is assumed to be Trv, required reverse bias voltage Vrv is, Vrv=Vgs×Tdsp/Trv. Application of this reverse bias voltage will result in that voltage stresses during one image frame are equalized between positive and negative sides and the average voltage stress becomes zero.

That is, reverse bias factor Kr set in amplifier 25*d* in the organic EL display device according to the third embodiment is, Kr=Tdsp/Trv. But, reverse bias period Trv is a part of program period Tprg, which is naturally far shorter than display period Tdsp. Accordingly, reverse bias factor Kr is set to a large value and reverse bias voltage Vrv becomes a high voltage.

The maximum voltage which can be set as reverse bias voltage Vrv is power source voltage Vdd. When display of high luminance is performed, therefore, the voltage stress may not be offset by the reverse bias voltage, resulting in reverse bias shortage.

Figure 19:
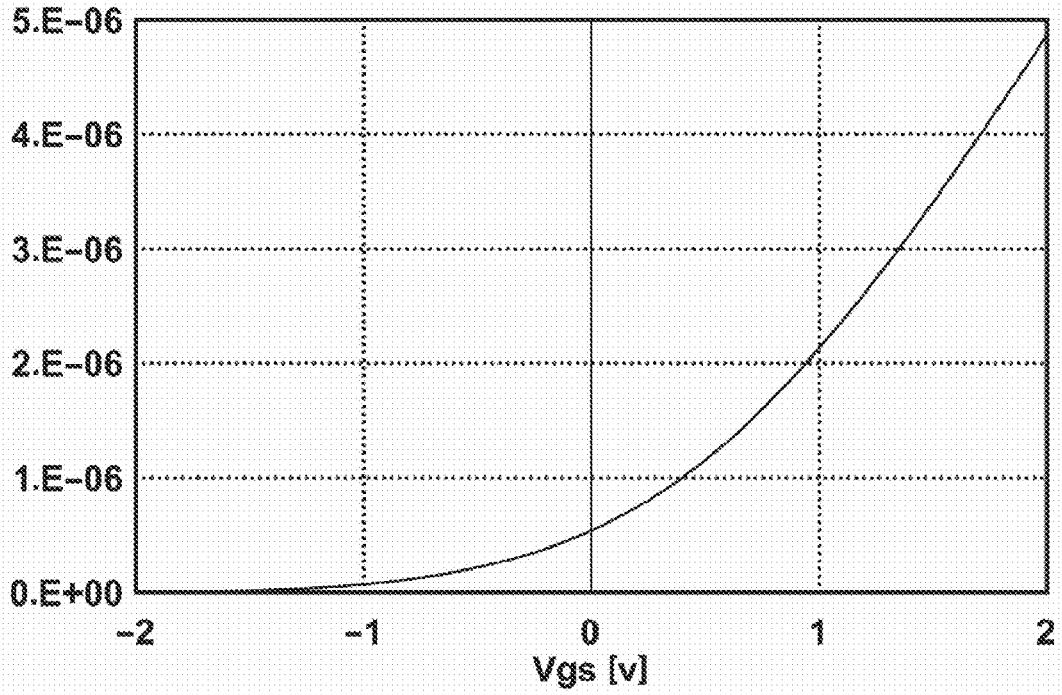
FIG. 19 illustrates an example current characteristic of a drive transistor whose threshold voltage Vth is a negative voltage.

Consequently, as drive transistor 11*b*, a thin film transistor having a current characteristic with Vth (threshold voltage)<0 may be used, in order to solve this problem. An example current characteristic of a drive transistor with threshold voltage Vth<0 is shown in FIG. 19.

Where a drive transistor with a negative threshold voltage is used as drive transistor 11*b*, both positive and negative voltages are applied as Vgs at the time of image display, so that the reverse bias voltages have both positive and negative polarities, whereby the reverse bias shortage due to the limited value of reverse bias voltage may be prevented.

Further, in the organic EL display devices according to the first to third embodiments, characteristic value calculation and Vgsn setting may be performed regardless of the polarity of the threshold voltage of drive transistor 11*b*, so that the use of a voltage in a negative voltage range as Vgs allows the reverse bias voltage setting range to be increased, whereby a long-term stability may be improved.

Still further, in the organic EL display devices according to the first to third embodiments, an n-type thin film transistor of amorphous silicon or inorganic oxide film can be used as the drive transistor as described above, and, in particular, an n-type thin film transistor of IGZO is preferably used as the drive transistor.

The use of reversible threshold voltage shift of the thin film transistor of IGZO allows the threshold voltage to be returned to the initial value while, for example, a black screen is displayed or power is turned OFF, so that the threshold voltage shift can further be prevented. Further, the threshold voltage of drive transistor 11*b* can be easily turned into negative voltage.

Further, in the organic EL display devices according to the first to third embodiments, as the means for calculating differential voltages ΔVs1 and ΔVs2, the second differential amplifier of analog circuit is used, but the calculation means is not limited to the analog circuit, and the voltages may be calculated by digital operations. Further, as the means for calculating display source voltage Vsn, the first differential amplifier of analog circuit is used, but the voltage may also be calculated by digital operations. Still further, if fixed voltage VB is set to zero, VB=0, the calculations described above will not be required.

Still further, in the organic EL display devices according to the first to third embodiments, MU calculation unit, VTH calculation unit, and VGS calculation unit are provided to digitally calculate MU, VTH, and Vgsn, but these units may be replaced by a DSP or a CPU.

Further, in the organic EL display devices according to the first to third embodiments, the calculation unit for calculating characteristic values may be included in the source drive circuit, provided independently, or included in control unit 16.

Still further, the embodiments of the present invention described above are embodiments in which the display apparatus of the present invention is applied to an organic EL display device. But, as for the light emitting element, it is not limited to an organic EL element and, for example, an inorganic EL element or the like may also be used.

In the embodiments described above, a measuring voltage is supplied to cause a current to flow through a drive transistor and a parasitic capacitance of the organic EL element is charged by the current to obtain a voltage variation at the source terminal of the drive transistor, and a value of drive current of the drive transistor is obtained based on the variation. But the target to be charged by the current that flows through the drive transistor by the supply of the measuring voltage is not limited to the parasitic capacitance of the organic EL element and it may be, for example, a wiring capacitance or a gate parasitic capacitance of the measuring transistor. Further, an auxiliary capacitor may be provided in parallel with the organic EL element and the auxiliary capacitor may be charged.

The display apparatus of the present invention has many applications. For example, it is applicable to personal digital assistants (electronic notebooks, mobile computers, cell phones, and the like), video cameras, digital cameras, personal computers, TV sets, and the like.

What is claimed is:

1. A display apparatus, comprising:

an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line;

a scan drive unit for sequentially selecting pixel circuit rows and turning ON the source connection switches of pixel circuits in the selected pixel circuit row;

a source drive unit having a current value acquisition unit for supplying a preset first measuring voltage to the source terminal of the drive transistor via the data line and source connection switch, acquiring a first voltage variation at the source terminal of the drive transistor when a capacitive load connected to the source terminal of the drive transistor is charged by a current flowing through the drive transistor by the supply of the first measuring voltage, acquiring a first current value with respect to the drive current of the drive transistor based on the first voltage variation, supplying a preset second measuring voltage to the source terminal of the drive transistor via the data line and source connection switch, acquiring a second voltage variation at the source terminal of the drive transistor when the capacitive load connected to the source terminal of the drive transistor is charged by a current that flows through the drive transistor by the supply of the second measuring voltage, and acquiring a second current value with respect to the drive current of the drive transistor based on the second voltage variation, a characteristic value acquisition unit for acquiring threshold voltage based and mobility based characteristic values of the drive transistor based on the first measuring voltage, second measuring voltage, first current value, and second current value, and a data signal output unit for outputting a data signal based on the characteristic values obtained by the characteristic value acquisition unit and a drive voltage of the drive transistor corresponding to the amount of emission of the light emitting element to the source terminal of the drive transistor via the data line and source connection switch;

a characteristic value storage unit for storing characteristic values of the drive transistor of each pixel circuit; and a control unit for displaying an image based on a data signal with respect to each frame by causing the scan drive unit to repeat the selection from the first to last pixel circuit row, wherein:

the current value acquisition unit is a unit that sequentially switches and selects some of pixel circuits in a pixel circuit row selected by the scan drive unit with respect to each frame and obtains the first and second current values of each selected pixel circuit;

the characteristic value acquisition unit is a unit that obtains the characteristic values of each pixel circuit selected by the current value acquisition unit and outputs the obtained characteristic values to the characteristic value storage unit to update previously stored characteristic values of each selected pixel circuit; and the data signal output unit is a unit that outputs, for each selection pixel circuit selected by the current value acquisition unit, a data signal based on the characteristic values obtained by the characteristic value acquisition unit when selected and a drive voltage of the drive transistor corresponding to the amount of emission of the light emitting element to the source terminal of the drive transistor of each selection pixel circuit via the data line and source connection switch and outputs, for each non-selection pixel circuit not selected by the current value acquisition unit, a data signal based on the characteristic values stored in the characteristic value storage unit when selected last time and a drive voltage of the drive transistor corresponding to the amount of emission of the light emitting element to the source terminal of the drive transistor of each non-selection pixel circuit via the data line and source connection switch.

2. The display apparatus of claim 1, wherein the some of pixel circuits selected by the current value acquisition unit are pixel circuits respectively having red, green, and blue light emitting elements belonging to one display pixel.

3. A display apparatus, comprising:

an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line;

a scan drive unit for sequentially selecting pixel circuit rows and turning ON the source connection switches of pixel circuits in the selected pixel circuit row;

a source drive unit having a current value acquisition unit for supplying a preset measuring voltage to the source terminal of the drive transistor via the data line and source connection switch, acquiring a voltage variation at the source terminal of the drive transistor when a capacitive load connected to the source terminal of the drive transistor is charged by a current flowing through the drive transistor by the supply of the measuring voltage, and acquiring a current value with respect to the drive current of the drive transistor based on the voltage variation, a characteristic value acquisition unit for acquiring a threshold voltage based or a mobility based characteristic value of the drive transistor based on the measuring voltage and current value, and a data signal output unit for outputting a data signal based on the characteristic value obtained by the characteristic value acquisition unit and a drive voltage of the drive transistor corresponding to the amount of emission of the light emitting element to the source terminal of the drive transistor via the data line and source connection switch;

a characteristic value storage unit for storing a characteristic value of the drive transistor of each pixel circuit; and a control unit for displaying an image based on a data signal with respect to each frame by causing the scan drive unit to repeat the selection from the first to last pixel circuit row, wherein:

the current value acquisition unit is a unit that sequentially switches and selects some of pixel circuits in a pixel circuit row selected by the scan drive unit with respect to each frame and obtains the current value of each selected pixel circuit;

the characteristic value acquisition unit is a unit that obtains the characteristic value of each pixel circuit selected by the current value acquisition unit and outputs the obtained characteristic value to the characteristic value storage unit to update previously stored characteristic value of each selected pixel circuit; and the data signal output unit is a unit that outputs, for each selection pixel circuit selected by the current value acquisition unit, a data signal based on the characteristic value obtained by the characteristic value acquisition unit when selected and a drive voltage of the drive transistor corresponding to the amount of emission of the light emitting element to the source terminal of the drive transistor of each selection pixel circuit via the data line and source connection switch and outputs, for each non-selection pixel circuit not selected by the current value acquisition unit, a data signal based on the characteristic value stored in the characteristic value storage unit when selected last time and a drive voltage of the drive transistor corresponding to the amount of emission of the light emitting element to the source terminal of the drive transistor of each non-selection pixel circuit via the data line and source connection switch.

4. The display apparatus of claim 3, wherein the some of pixel circuits selected by the current value acquisition unit are pixel circuits respectively having red, green, and blue light emitting elements belonging to one display pixel.

5. A display apparatus, comprising:

an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line;

a scan drive unit for sequentially selecting pixel circuit rows and turning ON the source connection switches of pixel circuits in the selected pixel circuit row;

a source drive unit having a current value acquisition unit for supplying a preset first measuring voltage to the source terminal of the drive transistor via the data line and source connection switch, acquiring a first voltage variation at the source terminal of the drive transistor when a capacitive load connected to the source terminal of the drive transistor is charged by a current flowing through the drive transistor by the supply of the first measuring voltage, acquiring a first current value with respect to the drive current of the drive transistor based on the first voltage variation, supplying a preset second measuring voltage to the source terminal of the drive transistor via the data line and source connection switch, acquiring a second voltage variation at the source terminal of the drive transistor when the capacitive load connected to the source terminal of the drive transistor is charged by a current that flows through the drive transistor by the supply of the second measuring voltage, and acquiring a second current value with respect to the drive current of the drive transistor based on the second voltage variation, a characteristic value acquisition unit for acquiring threshold voltage based and mobility based characteristic values of the drive transistor based on the first measuring voltage, second measuring voltage, first current value, and second current value, and a data signal output unit for outputting a data signal based on the characteristic values obtained by the characteristic value acquisition unit and a drive voltage of the drive transistor corresponding to the amount of emission of the light emitting element to the source terminal of the drive transistor via the data line and source connection switch;

a characteristic value storage unit for storing characteristic values of the drive transistor of each pixel circuit; and a control unit for displaying an image based on a data signal with respect to each frame by causing the scan drive unit to repeat the selection from the first to last pixel circuit row, wherein:

the current value acquisition unit is a unit that sequentially switches and selects some of the first to last pixel circuit row with respect to each frame and obtains the first and second current values of each pixel circuit in each selected pixel circuit row;

the characteristic value acquisition unit is a unit that obtains the characteristic values of each pixel circuit in each pixel circuit row selected by the current value acquisition unit and outputs the obtained characteristic values to the characteristic value storage unit to update previously stored characteristic values of each pixel circuit in each selected pixel circuit row; and the data signal output unit is a unit that outputs, for each pixel circuit in each selection pixel circuit row selected by the current value acquisition unit, a data signal based on the characteristic values obtained by the characteristic value acquisition unit when selected and a drive voltage of the drive transistor corresponding to the amount of emission of the light emitting element to the source terminal of the drive transistor of each pixel circuit in each selection pixel circuit row via the data line and source connection switch and outputs, for each pixel circuit in each non-selection pixel circuit row not selected by the current value acquisition unit, a data signal based on the characteristic values stored in the characteristic value storage unit when selected last time and a drive voltage of the drive transistor corresponding to the amount of emission of the light emitting element to the source terminal of the drive transistor of each pixel circuit in each non-selection pixel circuit via the data line and source connection switch.

6. A display apparatus, comprising:

an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line;

a scan drive unit for sequentially selecting pixel circuit rows and turning ON the source connection switches of pixel circuits in the selected pixel circuit row;

a source drive unit having a current value acquisition unit for supplying a preset measuring voltage to the source terminal of the drive transistor via the data line and source connection switch, acquiring a voltage variation at the source terminal of the drive transistor when a capacitive load connected to the source terminal of the drive transistor is charged by a current flowing through the drive transistor by the supply of the measuring voltage, and acquiring a current value with respect to the drive current of the drive transistor based on the voltage variation, a characteristic value acquisition unit for acquiring a threshold voltage based or a mobility based characteristic value of the drive transistor based on the measuring voltage and current value, and a data signal output unit for outputting a data signal based on the characteristic value obtained by the characteristic value acquisition unit and a drive voltage of the drive transistor corresponding to the amount of emission of the light emitting element to the source terminal of the drive transistor via the data line and source connection switch;

a characteristic value storage unit for storing characteristic values of the drive transistor of each pixel circuit; and a control unit for displaying an image based on a data signal with respect to each frame by causing the scan drive unit to repeat the selection from the first to last pixel circuit row, wherein:

the current value acquisition unit is a unit that sequentially switches and selects some of the first to last pixel circuit row with respect to each frame and obtains the current value of each pixel circuit in each selected pixel circuit row;

the characteristic value acquisition unit is a unit that obtains the characteristic value of each pixel circuit in each pixel circuit row selected by the current value acquisition unit and outputs the obtained characteristic value to the characteristic value storage unit to update previously stored characteristic value of each pixel circuit in each selected pixel circuit row; and the data signal output unit is a unit that outputs, for each pixel circuit in each selection pixel circuit row selected by the current value acquisition unit, a data signal based on the characteristic value obtained by the characteristic value acquisition unit when selected and a drive voltage of the drive transistor corresponding to the amount of emission of the light emitting element to the source terminal of the drive transistor of each pixel circuit in each selection pixel circuit row via the data line and source connection switch and outputs, for each pixel circuit in each non-selection pixel circuit row not selected by the current value acquisition unit, a data signal based on the characteristic value stored in the characteristic value storage unit when selected last time and a drive voltage of the drive transistor corresponding to the amount of emission of the light emitting element to the source terminal of the drive transistor of each pixel circuit in each non-selection pixel circuit row via the data line and source connection switch.

7. A method for drive controlling a display apparatus which includes an active matrix substrate with an array of multiple pixel circuits, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and a data line that supplies a predetermined data signal, the method comprising the steps of:

supplying a preset first measuring voltage to the source terminal of the drive transistor via the data line and source connection switch;

acquiring a first voltage variation at the source terminal of the drive transistor when a capacitive load connected to the source terminal of the drive transistor is charged by a current flowing through the drive transistor by the supply of the first measuring voltage and acquiring a first current value with respect to the drive current of the drive transistor based on the first voltage variation;

supplying a preset second measuring voltage to the source terminal of the drive transistor via the data line and source connection switch;

acquiring a second voltage variation at the source terminal of the drive transistor when the capacitive load connected to the source terminal of the drive transistor is charged by a current that flows through the drive transistor by the supply of the second measuring voltage and acquiring a second current value with respect to the drive current of the drive transistor based on the second voltage variation;

acquiring threshold voltage based and mobility based characteristic values of the drive transistor based on the first measuring voltage, second measuring voltage, first current value, and second current value; and outputting a data signal based on the obtained characteristic values and a drive voltage of the drive transistor corresponding to the amount of emission of the light emitting element to the source terminal of the drive transistor via the data line and source connection switch.

8. A method for drive controlling a display apparatus which includes an active matrix substrate with an array of multiple pixel circuits, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and a data line that supplies a predetermined data signal, the method comprising the steps of:

supplying a preset measuring voltage to the source terminal of the drive transistor via the data line and source connection switch;

acquiring a voltage variation at the source terminal of the drive transistor when a capacitive load connected to the source terminal of the drive transistor is charged by a current flowing through the drive transistor by the supply of the measuring voltage and acquiring a current value with respect to the drive current of the drive transistor based on the voltage variation;

acquiring a threshold voltage based or a mobility based characteristic value of the drive transistor based on the measuring voltage and current value; and outputting a data signal based on the obtained characteristic value and a drive voltage of the drive transistor corresponding to the amount of emission of the light emitting element to the source terminal of the drive transistor via the data line and source connection switch.

9. A method for drive controlling a display apparatus which includes: an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line; a scan drive unit for sequentially selecting pixel circuit rows and turning ON the source connection switches of pixel circuits in the selected pixel circuit row; and a control unit for displaying an image based on a data signal with respect to each frame by causing the scan drive unit to repeat the selection from the first to last pixel circuit row, the method comprising the steps of:

sequentially switching and selecting some of pixel circuits in a pixel circuit row selected by the scan drive unit with respect to each frame;

for each selection pixel circuit selected from those in the pixel circuit row selected by the scan drive unit:

supplying a preset first measuring voltage to the source terminal of the drive transistor via the data line and source connection switch and acquiring a first voltage variation at the source terminal of the drive transistor when a capacitive load connected to the source terminal of the drive transistor is charged by a current flowing through the drive transistor by the supply of the first measuring voltage and acquiring a first current value with respect to the drive current of the drive transistor based on the first voltage variation;

supplying a preset second measuring voltage to the source terminal of the drive transistor via the data line and source connection switch and acquiring a second voltage variation at the source terminal of the drive transistor when the capacitive load connected to the source terminal of the drive transistor is charged by a current that flows through the drive transistor by the supply of the second measuring voltage and acquiring a second current value with respect to the drive current of the drive transistor based on the second voltage variation; and acquiring threshold voltage based and mobility based characteristic values of the drive transistor based on the first measuring voltage, second measuring voltage, first current value, and second current value, outputting a data signal based on the obtained characteristic values and a drive voltage of the drive transistor corresponding to the amount of emission of the light emitting element to the source terminal of the drive transistor via the data line and source connection switch, and storing the obtained characteristic values in a characteristic value storage unit, and for each non-selection pixel circuit not selected from those in the pixel circuit row selected by the scan drive unit, outputting a data signal based on the characteristic values stored in the characteristic value storage unit when selected last time and a drive voltage of the drive transistor corresponding to the amount of emission of the light emitting element to the source terminal of the drive transistor via the data line and source connection switch.

10. A method for drive controlling a display apparatus which includes: an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line; a scan drive unit for sequentially selecting pixel circuit rows and turning ON the source connection switches of pixel circuits in the selected pixel circuit row; and a control unit for displaying an image based on a data signal with respect to each frame by causing the scan drive unit to repeat the selection from the first to last pixel circuit row, the method comprising the steps of:

sequentially switching and selecting some of pixel circuits in a pixel circuit row selected by the scan drive unit with respect to each frame;

for each selection pixel circuit selected from those in the pixel circuit row selected by the scan drive unit:

supplying a preset measuring voltage to the source terminal of the drive transistor via the data line and source connection switch and acquiring a voltage variation at the source terminal of the drive transistor when a capacitive load connected to the source terminal of the drive transistor is charged by a current flowing through the drive transistor by the supply of the measuring voltage and acquiring a current value with respect to the drive current of the drive transistor based on the voltage variation; and acquiring a threshold voltage based or a mobility based characteristic value of the drive transistor based on the measuring voltage and current value, outputting a data signal based on the obtained characteristic value and a drive voltage of the drive transistor corresponding to the amount of emission of the light emitting element to the source terminal of the drive transistor via the data line and source connection switch, and storing the obtained characteristic value in a characteristic value storage unit, and for each non-selection pixel circuit not selected from those in the pixel circuit row selected by the scan drive unit, outputting a data signal based on the characteristic value stored in the characteristic value storage unit when selected last time and a drive voltage of the drive transistor corresponding to the amount of emission of the light emitting element to the source terminal of the drive transistor via the data line and source connection switch.

11. A method for drive controlling a display apparatus which includes: an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line; a scan drive unit for sequentially selecting pixel circuit rows and turning ON the source connection switches of pixel circuits in the selected pixel circuit row; and a control unit for displaying an image based on a data signal with respect to each frame by causing the scan drive unit to repeat the selection from the first to last pixel circuit row, the method comprising the steps of:

sequentially switching and selecting some of the first to last pixel circuit row with respect to each frame;

for each pixel circuit in each selection pixel circuit row selected:

supplying a preset first measuring voltage to the source terminal of the drive transistor via the data line and source connection switch and acquiring a first voltage variation at the source terminal of the drive transistor when a capacitive load connected to the source terminal of the drive transistor is charged by a current flowing through the drive transistor by the supply of the first measuring voltage and acquiring a first current value with respect to the drive current of the drive transistor based on the first voltage variation;

supplying a preset second measuring voltage to the source terminal of the drive transistor via the data line and source connection switch and acquiring a second voltage variation at the source terminal of the drive transistor when the capacitive load connected to the source terminal of the drive transistor is charged by a current that flows through the drive transistor by the supply of the second measuring voltage and acquiring a second current value with respect to the drive current of the drive transistor based on the second voltage variation; and acquiring threshold voltage based and mobility based characteristic values of the drive transistor based on the first measuring voltage, second measuring voltage, first current value, and second current value, outputting a data signal based on the obtained characteristic values and a drive voltage of the drive transistor corresponding to the amount of emission of the light emitting element to the source terminal of the drive transistor via the data line and source connection switch, and storing the obtained characteristic values in a characteristic value storage unit, and for each pixel circuit in each non-selection pixel circuit row not selected, outputting a data signal based on the characteristic values stored in the characteristic value storage unit when selected last time and a drive voltage of the drive transistor corresponding to the amount of emission of the light emitting element to the source terminal of the drive transistor via the data line and source connection switch.

12. A method for drive controlling a display apparatus which includes: an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line; a scan drive unit for sequentially selecting pixel circuit rows and turning ON the source connection switches of pixel circuits in the selected pixel circuit row; and a control unit for displaying an image based on a data signal with respect to each frame by causing the scan drive unit to repeat the selection from the first to last pixel circuit row, the method comprising the steps of:

sequentially switching and selecting some of the first to last pixel circuit row with respect to each frame;

for each pixel circuit in each selection pixel circuit row selected:

supplying a preset measuring voltage to the source terminal of the drive transistor via the data line and source connection switch and acquiring a voltage variation at the source terminal of the drive transistor when a capacitive load connected to the source terminal of the drive transistor is charged by a current flowing through the drive transistor by the supply of the measuring voltage and acquiring a current value with respect to the drive current of the drive transistor based on the voltage variation; and acquiring a threshold voltage based or a mobility based characteristic value of the drive transistor based on the measuring voltage and current value, outputting a data signal based on the obtained characteristic value and a drive voltage of the drive transistor corresponding to the amount of emission of the light emitting element to the source terminal of the drive transistor via the data line and source connection switch, and storing the obtained characteristic value in a characteristic value storage unit, and for each pixel circuit in each non-selection pixel circuit row not selected, outputting a data signal based on the characteristic value stored in the characteristic value storage unit when selected last time and a drive voltage of the drive transistor corresponding to the amount of emission of the light emitting element to the source terminal of the drive transistor via the data line and source connection switch.

13. A display apparatus, comprising:

an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line; and a source drive circuit having a current value acquisition unit for supplying a preset measuring voltage to the source terminal of the drive transistor via the data line and source connection switch, acquiring a voltage variation at the source terminal of the drive transistor when a capacitive load connected to the source terminal of the drive transistor is charged by a current flowing through the drive transistor by the supply of the measuring voltage, and acquiring a current value with respect to the drive current of the drive transistor based on the voltage variation, a characteristic value acquisition unit for acquiring a threshold voltage based or a mobility based characteristic value of the drive transistor based on the measuring voltage and current value, and a data signal output unit for outputting a data signal based on the characteristic value obtained by the characteristic value acquisition unit and a drive voltage of the drive transistor corresponding to the amount of emission of the light emitting element to the source terminal of the drive transistor via the data line and source connection switch.

14. A display apparatus, comprising:

an active matrix substrate with an array of multiple pixel circuits and a data line provided with respect to each pixel circuit column for supplying a predetermined signal, each pixel circuit having a light emitting element, a drive transistor with a source terminal connected to an anode terminal of the light emitting element to apply a drive current to the light emitting element, a capacitor element connected between a gate terminal and the source terminal of the drive transistor, a gate connection switch connected between the gate terminal of the drive transistor and a voltage source that supplies a predetermined voltage, and a source connection switch connected between the source terminal of the drive transistor and the data line, and a source drive circuit having a current value acquisition unit for supplying a preset first measuring voltage to the source terminal of the drive transistor via the data line and source connection switch, acquiring a first voltage variation at the source terminal of the drive transistor when a capacitive load connected to the source terminal of the drive transistor is charged by a current flowing through the drive transistor by the supply of the first measuring voltage, acquiring a first current value with respect to the drive current of the drive transistor based on the first voltage variation, supplying a preset second measuring voltage to the source terminal of the drive transistor via the data line and source connection switch, acquiring a second voltage variation at the source terminal of the drive transistor when the capacitive load connected to the source terminal of the drive transistor is charged by a current that flows through the drive transistor by the supply of the second measuring voltage, and acquiring a second current value with respect to the drive current of the drive transistor based on the second voltage variation, a characteristic value acquisition unit for acquiring threshold voltage based and mobility based characteristic values of the drive transistor based on the first measuring voltage, second measuring voltage, first current value, and second current value, and a data signal output unit for outputting a data signal based on the characteristic values obtained by the characteristic value acquisition unit and a drive voltage of the drive transistor corresponding to the amount of emission of the light emitting element to the source terminal of the drive transistor via the data line and source connection switch.

15. The display apparatus of claim 14, further comprising a reverse bias voltage output unit for supplying a reverse bias voltage of a magnitude corresponding to the data signal outputted to the drive transistor to the gate terminal of the drive transistor.

16. The display apparatus of claim 15, wherein the drive transistor is a thin film transistor having a current characteristic with a negative threshold voltage.

17. The display apparatus of claim 15, wherein a common electrode wire is connected to the cathode terminal of the light emitting element to supply different voltages between a reverse bias voltage application period and a period other than the reverse bias voltage application period.

18. The display apparatus of claim 14, wherein the drive transistor is a thin film transistor of IGZO (InGaZnO).

* * * * *